United States Patent [19]

Nikaido et al.

[11] Patent Number: 4,681,007

[45] Date of Patent: Jul. 21, 1987

[54] SOUND GENERATOR FOR ELECTRONIC MUSICAL INSTRUMENT

[75] Inventors: Masataka Nikaido, Hirakata; Sakurako Matsuda, Joyo, both of Japan

[73] Assignee: Matsushita Electric Industrial Co., Ltd., Osaka, Japan

[21] Appl. No.: 746,119

[22] Filed: Jun. 18, 1985

[30] Foreign Application Priority Data

Jun. 20, 1984 [JP] Japan ..... 59-127062

[51] Int. Cl.[4] ..... G10H 1/46; G10H 7/00

[52] U.S. Cl. ..... 84/1.1; 84/1.27

[58] Field of Search ..... 84/1.1–1.13, 84/1.19–1.27

[56] References Cited

U.S. PATENT DOCUMENTS 4,411,185 10/1983 Deutsch ..... 84/1.1 X
4,552,051 11/1985 Takeuchi ..... 84/1.1 X
4,558,623 12/1985 Buchla ..... 84/1.1

FOREIGN PATENT DOCUMENTS 54-39615 3/1979 Japan .
60-3892 1/1985 Japan .

*Primary Examiner*—S. J. Witkowski
*Attorney, Agent, or Firm*—Wenderoth, Lind & Ponack

[57] ABSTRACT

A sound generator for an electronic musical instrument produces sounds from waveform data combinations stored in a memory. Each of the waveform data combinations is a data combination obtained from a waveform of a natural sound by digital data conversion preferably including information condensation. The selection of a waveform data combination is performed by an address generator which produces an address signal for the memory from an information from a keyboard. The information includes a touch information representing key depressing speed and/or strength, or both of the touch information and a pitch information. The loudness level of a generated tone is controlled by a loudness controller in response to the touch information, or to both of the touch information and pitch information.

26 Claims, 42 Drawing Figures

FIG. 1.

| OCTAVE NO. | OCT |
|---|---|
| 1 | 0 0 |
| 2 | 0 1 |
| 3 | 1 0 |
| 4 | 1 1 |

| NOTE NAME | NOTE |
|---|---|
| C | 0 0 0 0 |
| C# | 0 0 0 1 |
| D | 0 0 1 0 |
| D# | 0 0 1 1 |
| E | 0 1 0 0 |
| F | 0 1 0 1 |
| F# | 0 1 1 0 |
| G | 0 1 1 1 |
| G# | 1 0 0 0 |
| A | 1 0 0 1 |
| A# | 1 0 1 0 |
| B | 1 0 1 1 |

| LOUDNESS LEVEL | ppp | pp | p | mp | mf | f | ff | fff |
|---|---|---|---|---|---|---|---|---|
| DATA COMBINATION | 1ST COMB. | 2ND COMB. | 3RD COMB. | 4TH COMB. | 5TH COMB. | 6TH COMB. | 7TH COMB. | 8TH COMB. |
| t5–t7 (bin) | 000 | 001 | 010 | 011 | 100 | 101 | 110 | 111 |
| t0–t7 (hex) | 00 | | | | | | | FF |

FIG. 15.

| ADDRESS | | | DATA | |
|---|---|---|---|---|
| OCT | NOTE | t | a | ℓ |
| 0 | 9 | 0 | 00 | 10 |
| | | 1 | 00 | 11 |
| | | 2 | 00 | |
| | | 3 | | 75 |
| | | | 16 | 78 |
| | | D | 16 | 7A |
| | | E | 16 | 7D |
| 3 | B | F | 16 | 7F |
| 4 | 0 | 0 | 17 | 10 |
| | | 1 | 17 | 18 |
| | | 2 | 17 | 20 |
| | | 3 | 17 | 28 |
| | | 4 | 17 | 30 |
| | | 5 | 17 | 38 |
| | | 6 | 17 | 40 |
| | | 7 | 18 | 47 |
| | | 8 | 18 | 4E |
| | | 9 | 18 | 55 |
| | | A | 18 | 5C |
| | | B | 18 | 63 |
| | | C | 19 | 69 |
| | | D | 19 | 72 |
| | | E | 19 | 79 |
| | | F | 19 | 7F |
| | 1 | 0 | 17 | 10 |
| | | 1 | 17 | 19 |
| | | 2 | 17 | 21 |
| | | 3 | 17 | 20 |
| | | 4 | 17 | |
| | | 5 | | 52 |
| | | | | 5A |
| | | | 29 | 61 |
| | | C | 29 | 67 |
| | | D | 29 | 70 |
| | | E | 29 | 78 |
| 8 | | F | 29 | 7F |

FIG. 18.

| a | TAD |
|---|---|
| 00 | 0000 |
| 01 | |
| 02 | |
| | |
| | |
| 14 | |
| 15 | |
| 16 | |
| 17 | 4000 |
| 18 | 5000 |
| 19 | 5400 |
| 1A | 5800 |
| 1B | |
| 1C | |
| | |
| | |
| 26 | |
| 27 | |
| 28 | |
| 29 | |

| OCTAVE NO. | NUMBER OF SAMPLES PER WAVEFORM N | $\overline{MSK}$ 8 7 6 5 4 3 2 1 0 |
|---|---|---|
| 0 | 1024 | 1 1 1 1 1 1 1 1 0 |
| 1 | 512 | 1 1 1 1 1 1 1 0 1 |
| 2 | 256 | 1 1 1 1 1 1 0 1 1 |
| 3 | 128 | 1 1 1 1 1 0 1 1 1 |
| 4 | 64 | 1 1 1 1 0 1 1 1 1 |
| 5 | 32 | 1 1 1 0 1 1 1 1 1 |
| 6 | 16 | 1 1 0 1 1 1 1 1 1 |
| 7 | 8 | 1 0 1 1 1 1 1 1 1 |
| 8 | 4 | 0 1 1 1 1 1 1 1 1 |

FIG. 23.

| CONTROL DATA C | ΔMLP | PCM |
|---|---|---|
| '0'X | '1'X | 0 |
| '1'X | '2'X | 0 |
| '2'X | '4'X | 0 |
| '3'X | '8'X | 0 |
| '4'X | '10'X | 0 |
| '5'X | '20'X | 0 |
| '6'X | '40'X | 0 |
| '7'X | '80'X | 0 |
| '8'X | '100'X | 0 |
| '9'X | '200'X | 0 |
| 'A'X | '400'X | 0 |
| 'B'X | '800'X | 0 |
| 'C'X | '1000'X | 0 |
| 'D'X | '2000'X | 0 |
| 'E'X | '0'X | 0 |
| 'F'X | $2^{6+OCT}$ | 1 |

| OCTAVE NO. | OCT |
|---|---|
| 0 | 0 0 0 0 |
| 1 | 0 0 0 1 |
| 2 | 0 0 1 0 |
| 3 | 0 0 1 1 |
| 4 | 0 1 0 0 |
| 5 | 0 1 0 1 |
| 6 | 0 1 1 0 |
| 7 | 0 1 1 1 |
| 8 | 1 0 0 0 |

SOUND GENERATOR FOR ELECTRONIC MUSICAL INSTRUMENT

BACKGROUND OF THE INVENTION

1. Field of the Invention

This invention relates to a sound generator to be incorporated in an electronic musical instrument, and which is capable of varying the nuance of music sound generated in response to the key depression speed and strength.

2. Description of the Prior Art

Recently, the electronic musical instrument has been remakably developed in its sound quality and functions thanks to the introduction of high technology digital systems. There are those electronic musical instruments available in the market, which can generate highly qualified musical sounds very close to those issued by natural musical instruments, and which are provided with higher capability, e.g., of an automatic performance by means of microcomputer technology. The market now tends to continue to demand an appearance of those electonic musical instruments having a higher capability of music expression. As a method of facilitating various music expression, it has been well known that the quality and quantity of sound to be generated can be controlled in reponse to the speed of depression of the key, and the strength of impulse imposed on the key, associated with the initial stage of key depression (hereafter, the latter is to be referred to as the initial touch). For example, in the case of a piano, in which the sound quality is determinable exclusively by the initial touch, it is effective for the electronic musical instrument to simulate the musical sound by this method. Besides the above noted case, there is another case, where the generated sound will be varied in response to the status of the pressure, etc., imposed on the key after having been depressed (hereafter to be referred to as the after touch). This is effective for the electronic musical instrument to simulate the sound of a musical instrument, such as the trumpet, in that both of the quality and quantity of sound can be controlled appropriately even with regard to a constant pitch.

As for those facilitating the initial touch control, there has been proposed a method, in that the generated sound loudness is controlled by a VCA (a voltage control amplifier) in response to the value of detection, e.g., how fast the key is depressed. In this case, however, in spite of its capability of sound loudness control, it is still inadequate, when the electronic musical instrument is to simulate the sound of a piano, in the the timbre of sound is completely changeable depending upon the mode of performance, whether it is played strongly or weakly. There is another attmept proposed, where the generated sound is engaged with timbre control by means or a VCF (a voltage control filter) in response to the speed of key depression, further being controlled as to its loudness by means of a VCA. However, even in this case, it is not feasible to acquire an adequate result in the case of those musical sounds, e.g., associated with a piano performance, in that a variation of the timbre of sound will take place within a wide range depending upon the strength of the impulsive stroke on the leading edge of the sound wave and the subsequently following spectrum construction thereof, in reponse to whether it is played in a strong mood or in a weak mood.

Hereafter, in this invention, the value of detection of the initial touch should be referred to as the touch information.

The control method by means of conventional initial touch, as mentioned previously, in which a VCF and VCA are incorporated, is able to change the timbre and loudness of sound continuously. However, the variation of timbre in this control is simplified too much, on behalf of too much emphasis being placed on continuity of the variation of sound loudness or timbre, resulting in letting the sound generated be short of a natural tune.

An electronic musical instrument with a touch response capability is disclosed in U.S. Pat. No. 4,231,276. This patent proposes that a music sound is synthesized by mixing a complex number of wave-forms of high frequencies having the same basic number of frequencies superposed on different quantities of higher harmonics thereon, the ratio of mixing being changed in response to the touch response signal. This method makes it possible to improve the capability of touch response because the mixing ratio can be specified optionally in response to the degree of touch. However, the quality of sound thus produced cannot exceed the conventional boundary of the musical sound generated by synthesizing from a complex number of wave-forms.

Other prior art references relevant to this invention are given in the following U.S. Pat. Nos.: 3,515,792, 3,854,365, 4,085,648, 4,138,915, 4,224,856, and 4,227,435.

SUMMARY OF THE INVENTION

An object of the present invention is to provide a sound generator for an electronic musical instrument which can satisfy both the natural timbre and continuity of the varying sound quality and loudness of the generated sound simultaneously.

In order to achieve this object, a part or all of the sounds generated by real musical instrument from their generation to diminition are converted into digital signals, being stored in memories as is, or as waveform data which is obtained by a certain kind of information condensation process, and one of these complex numbers of waveform data being selected to be reproduced in response to initial touch information or to the initial touch information and pitch information, or otherwise the amplitude associated with the wave-form data reproduction is so arranged as to be modified in response to the initial touch information or the initial touch information and pitch information besides the selective reproduction.

By means of the configuration presented by this invention, it is feasible to obtain a sound generator for an electronic musical instrument which is provided not only with adequate capability of sound timbre and loudness variation in response to the strength and/or speed of depression of a key, but also with a function of touch response favored with an excellent naturalism in the generated sound.

BRIEF DESCRIPTION OF THE DRAWINGS

FIG. 1 is an illustration of octave information OCT and pitch name information Note in a first embodiment of this invention;

FIG. 15 is a diagram showing the contents of a conversion ROM in FIG. 14;

FIG. 18 is a diagram showing the contents of a start address ROM which is given in FIG. 17;

FIG. 23 is a diagram showing the relationship between control data C and ΔMLP;

DESCRIPTION OF THE PREFERRED EMBODIMENTS

Figure 2:
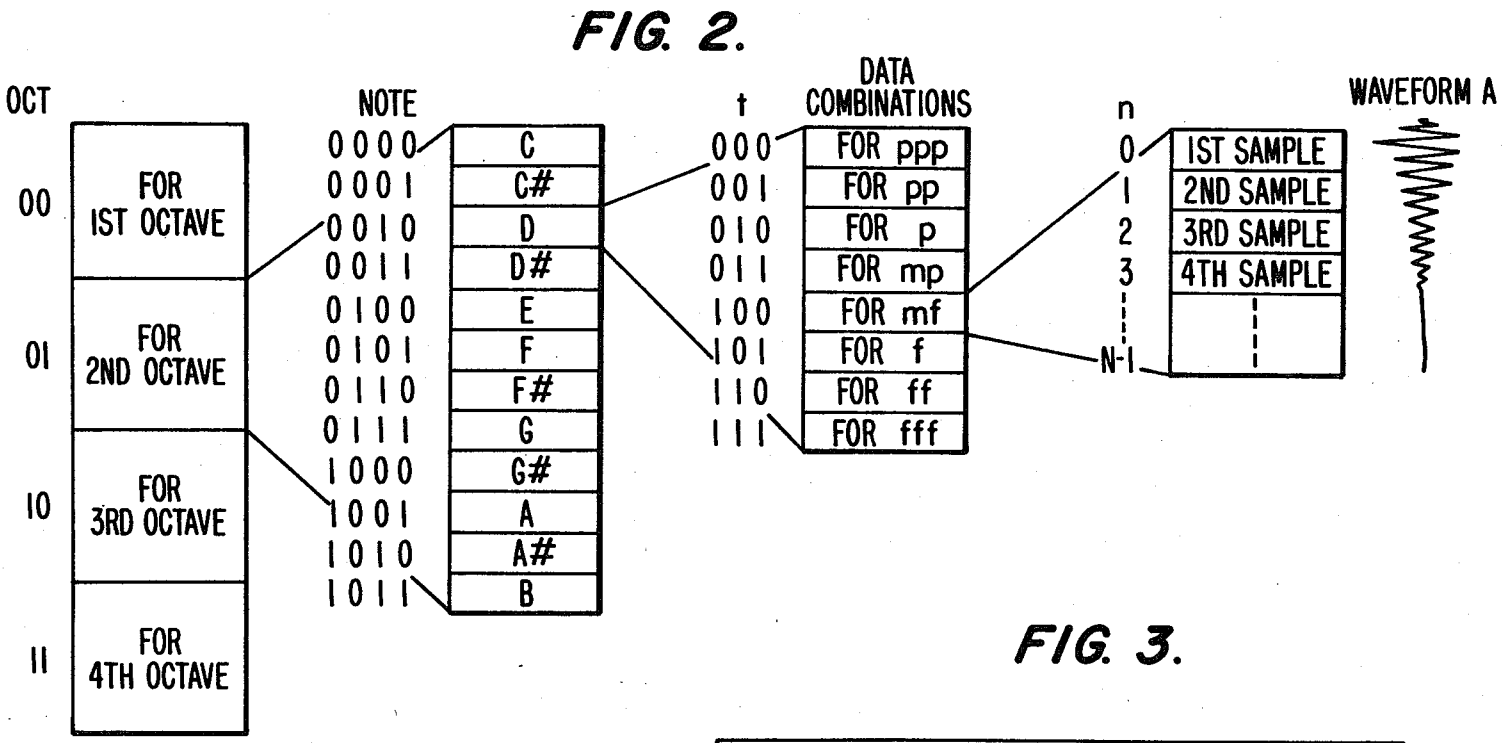
FIG. 2 is a diagram showing the contents of an ROM of the waveform data combination in the first embodiment of this invention.
Figure 3:
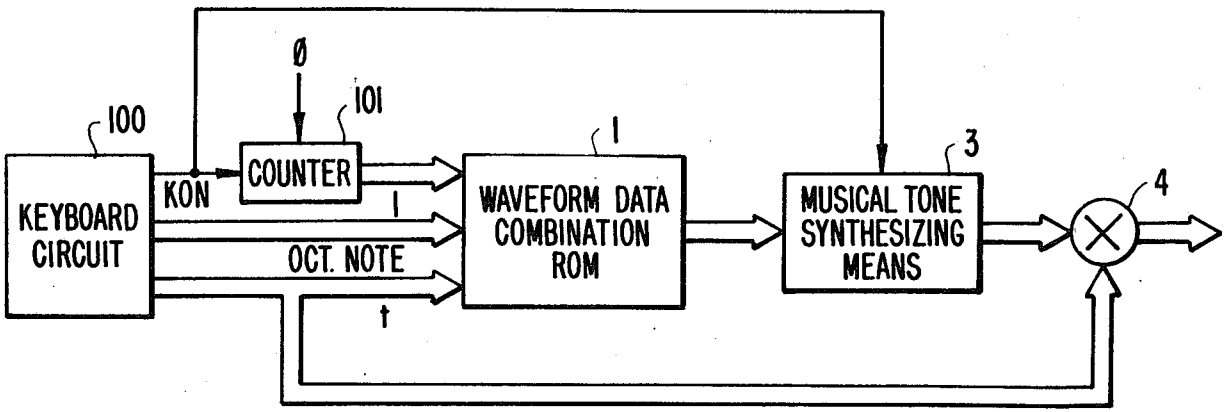
FIG. 3 is a block diagram of a sound generator for an electronic musical instrument in the first embodiment of this invention.

FIG. 3 is a block diagram of a sound generator for an electronic musical instrument in a first embodiment of the invention. In FIG. 3, 1 is a ROM for storing combinations of waveform data required for musical sound generation, 3 a musical sound synthesizing means for synthesizing a musical sound according to data which is supplied from ROM 1, a multiplier, 4 a keyboard circuit, 100 and a counter 101. The contents which are stored in the ROM 1 are shown in FIG. 2 as an example. In the example given in FIG. 2, a single tone, response to one key depressed from among 48 keys of four octaves is generated. Responding to the key being depressed, keyboard circuit 100 will generate a keying signal KON, octave information OCT, note information NOTE and touch information t, where OCT and NOTE are specified as shown in FIG. 1.

Figures 4, 5:
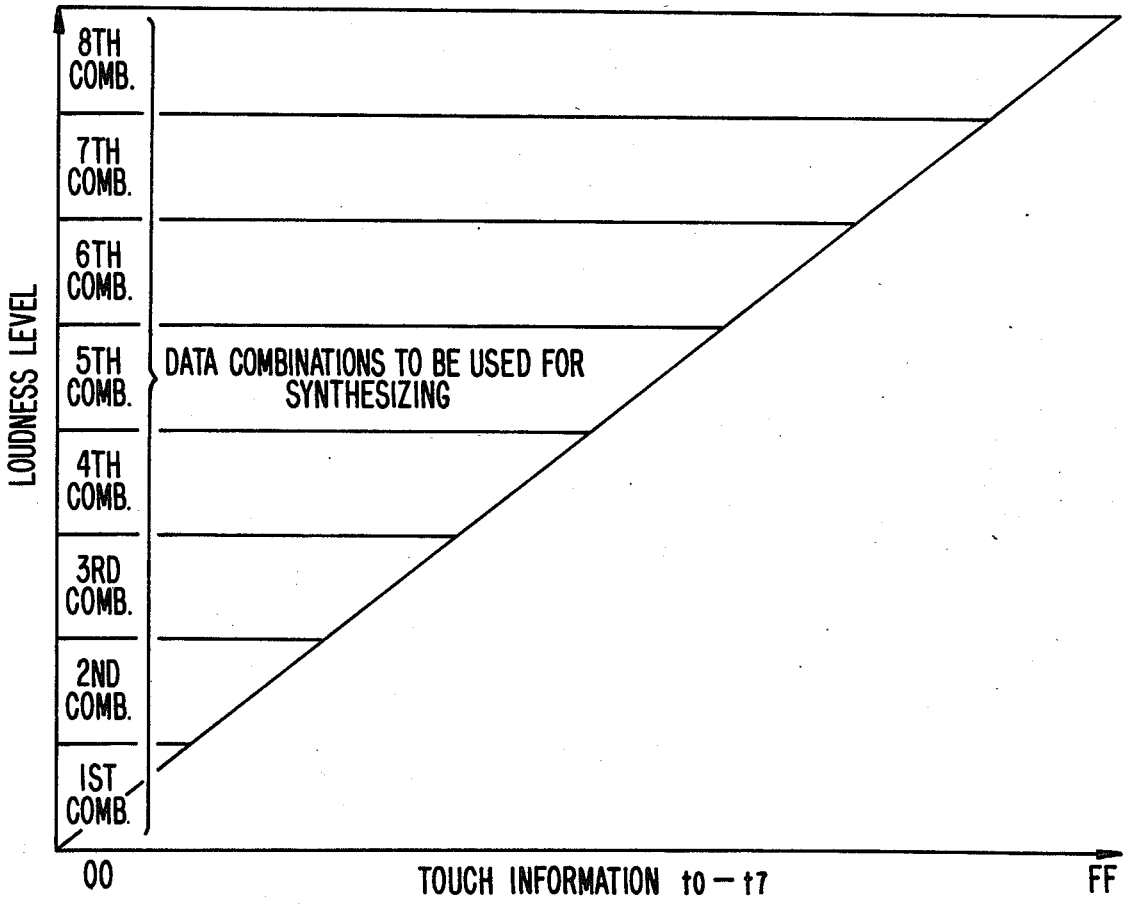
FIG. 4 and FIG. 5 are diagrams showing the relationships among the touch information, loudness level and data combination.

To ROM 1, address data are given in sequential order from the top onward: Octave information OCT, note information NOTE, touch information t, and a sample number n. Touch information t, e.g., refers to a 3 bit digital expression resulting from the value detected by a pressure sensor, for example, for the initial touch strength. Other examples are shown in U.S. Pat. No. 4,231,276. Sample number n is generated by means of counting from 0 through N-1 on counter 101, when a wavefrom data combination is composed of N pieces of sampled data. The waveform data combination is to be taken from such procedures as, loudnesses in music sound of, e.g., piano being actually played and recorded in terms of an eight-level continuum of nuances for ppp (pianississimo: extremely soft) to fff (fortississimo: extremely loud), each of the loudness level being digitized from the generation to the dimension for each of the eight loudness levels. The maximum amplitude of each individual loudness level is normalized so as to be the same amplitude throughout the eight levels. Finally the above result is taken as the waveform data combination. By means of the procedure as given above, it can be noticed from FIG. 2 that a D note in the second octave, for example, keyed with loudness mf, results in the reading out of digital waveform A from ROM 1, and subsequently the multiplier 4 will undertaken multiplication of the digital waveform A and touch information t, and output the result. In this example, 8 bits from $t_0$ through $t_7$ are taken as the values of touch information t, wherein hexadecimal digit expressions from '00'X through 'FF'X are incorporated, as shown in FIG. 4, to express levels of loudness from ppp (or pianississimo: extremely soft) to fff (or fortississimo: extremely loud). Hereafter " X is to be referred to as identifying a hexadecimal digit. The upper three bits, $t_5$-$t_7$ of the touch information are used for specifying waveform data combination. For example, if all of $t_5$ through $t_7$ are '0', the first combination which is the waveform data combination for ppp will be specified, and if all of $t_5$ through $t_7$ are '1', the eighth combination which is the waveform data combination for fff will be specified. Consequently, in response to a value among those from the one having touch information t='00'X through the one having t='FF'X, a waveform combination will be selected, and the music sound loudness level which is obtained as the output of multiplier 4 will be determined at one of the continuous levels $2^8=256$, as shown in FIG. 5.

In the example shown in FIG. 3, for example, when the D note of the second octave is played a little bit louder than mf, (e.g., t=10000011), the digital waveform A, as it is clearly understandable from FIG. 2, will be readout, and further by means of multiplier 4 t=10000011 is multiplied by waveform A, generating a musical sound having a slightly higher loudness, compared with the one in the case of exactly mf (t=10000000).

In FIG. 3, an optional loudness level can be selected from among 256 divided levels, so that the capability of representation of the musical peformance can be substantially enhanced. If the loudness level is not controlled in response to the touch information, the continuity of the loudness level becomes worse, so that the size of memory could not help being expanded because of the the necessity of the waveform data being increased.

In this respect, the example in FIG. 3 is not obliged to increase its data quantity, so that it considerably effects the economy of memory.

Next, a second embodiment of the invention will be explained.

Figure 6:
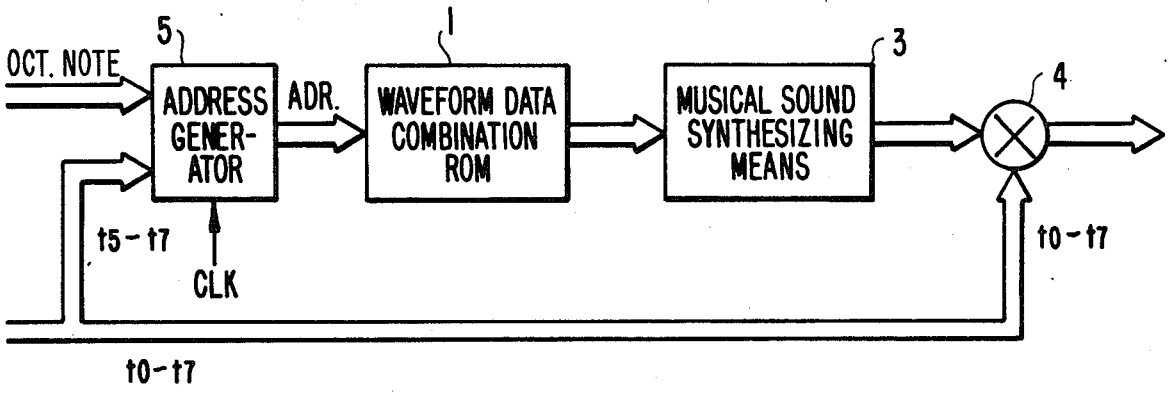
FIG. 6 is a block diagram of a sound generator for an electronic musical instrument in a second embodiment of this invention.

FIG. 6 is a block diagram of a sound generator for an electronic musical instrument in the second embodiment of the invention. Some particular explanation is omitted for the parts having the same block numbers as given for the example in FIG. 3; atternatively, the same numbering being given thereto as that given to the previous example, and the keyboard circuit 100 and counter 101 have not been shown. Element 5 is an address generator, which produces address data of ROM 1 from the pitch information, namely, the octave information OCT, note information NOTE and touch information $t_5$ through $t_7$. ROM 1 outputs the waveform data combination, taking the address input from the output of address generator 5, and supplying it to the musical sound synthesizing means 3. The musical sound synthesizing means 3 synthesizes a musical sound waveform from the waveform data provided by the ROM 1. The output of the musical sound synthesizor 3 is multiplied by the touch information $t_0$–$t_7$ by means of the multiplier 4.

Figure 7:
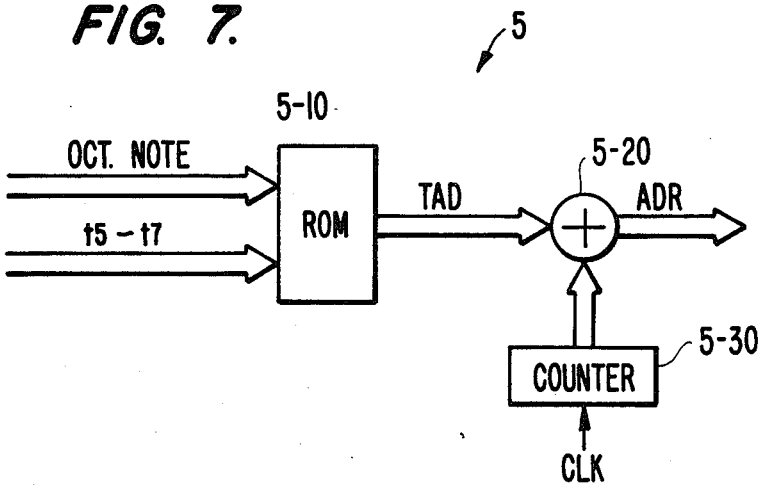
FIG. 7 is a block diagram showing an address generator configuration.

The configuration of the address generator 5 is given in FIG. 7, where 5–10 is a ROM which stores the start addresses TAD of a plurality of waveform data combinations stored in ROM 1, and 5–20 is an adder, and 5–30 is a counter. ROM 5–10 is loaded with additional address inputs, such as octave information OCT, note information NOTE, and touch information t. The address generator 5 will generate the address data to be stored in the ROM 1 by adding the count stored in counter 5–30 with the start address TAD which is read out by ROM 5–10 by the adder 5–20. The contents of ROM 5–10 are given in FIG. 8.

Figure 8:
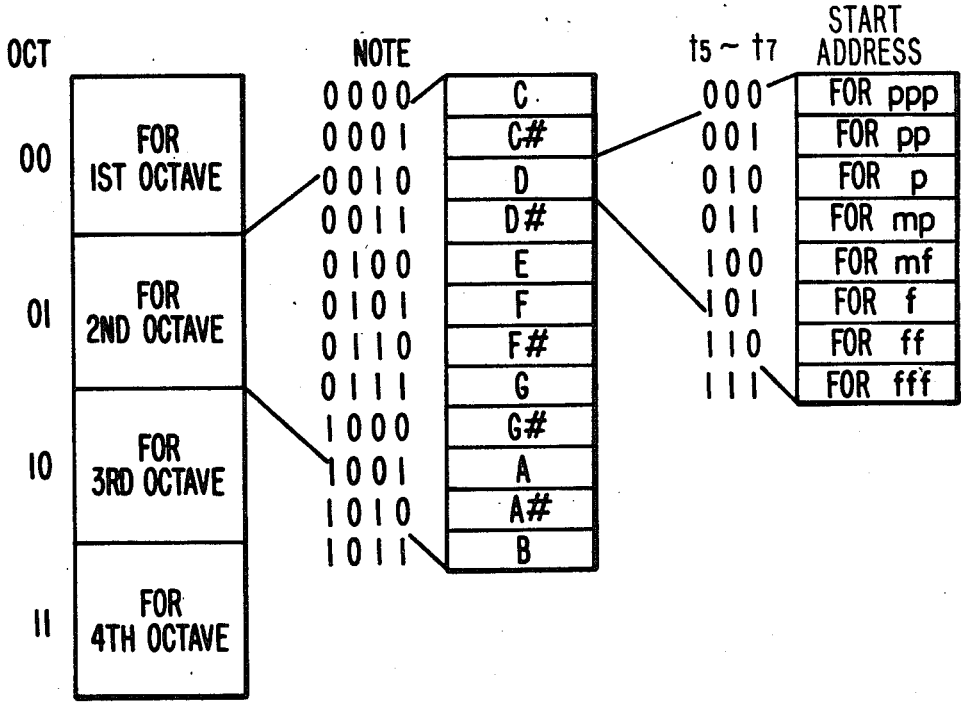
FIG. 8 is a diagram showing the contents of an ROM to be incorporated for address generation.

Referring to FIG. 8, in ROM 5–10, the start addresses TADs are stored in response to the waveform data combinations corresponding to the sound loudnesses in continuum of 8 levels from ppp to fff. The address range of ROM 5–10 has a 9 bit width, being composed of 2 bits of octave information OCT, note information NOTE of 4 bits, and 3 bits of touch information $t_5$–$t_7$, sequentially from the most significant bit downward.

Figure 9:
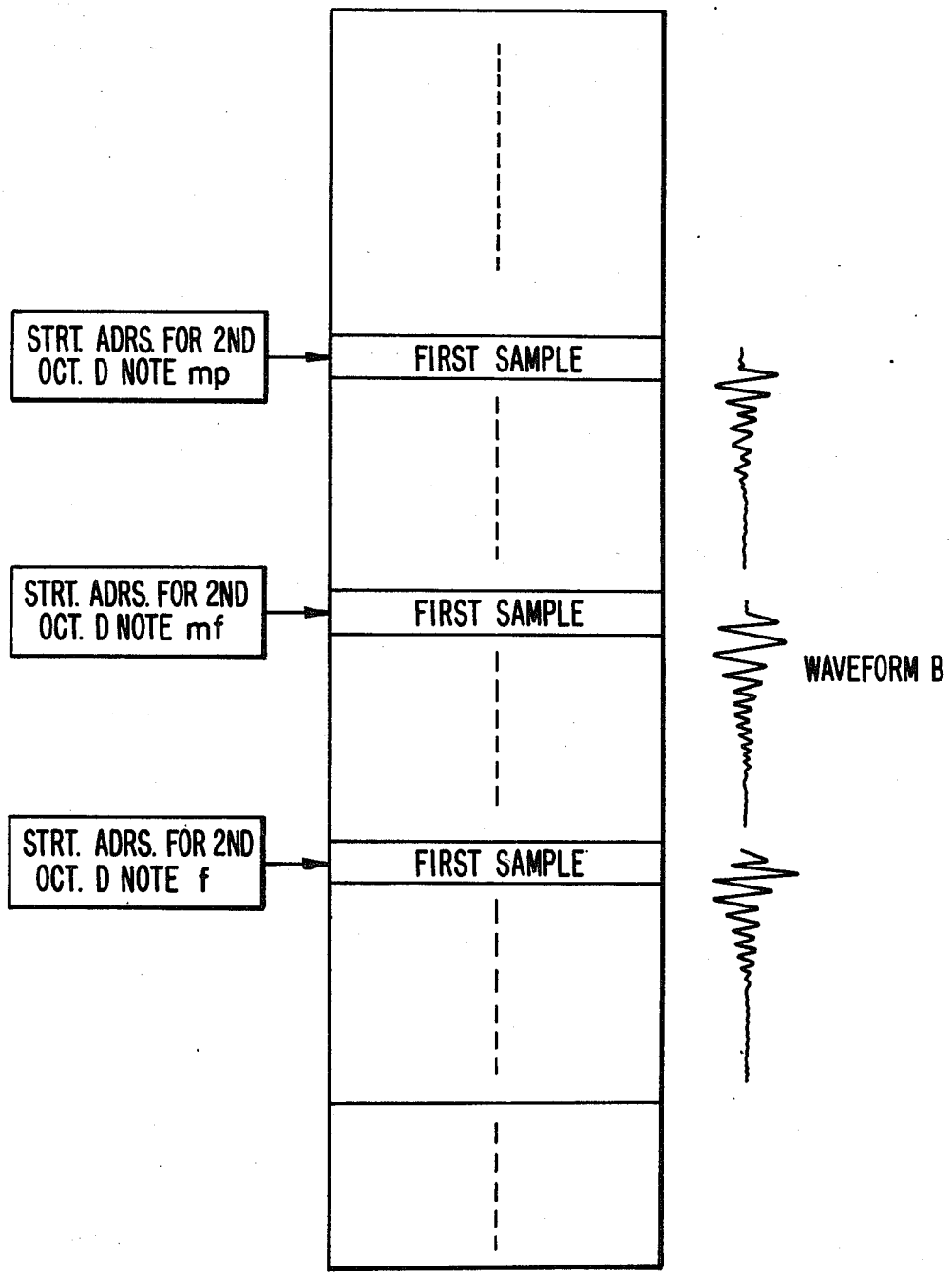
FIG. 9 is a diagram showing the contents of an ROM to be incorporated for data combination.

The waveform data combination to be stored in ROM 1 may be composed in such a way that, e.g., as shown in FIG. 9, a natural musical instrument is played and recorded in each level of loudness from ppp to fff in 8 loudness levels (in the maixmum), the waveform data of 8 combinations (in the maximum) being combined from 8 tones (in the maximum) digitized from the generation to the diminution for each of the original tones, the value of each amplitude being equalized in each of the maximum loudness levels, and finally the required combination being obtained. When the waveform data combination is used, it is not necessary to prepare any specific circuit as the musical sound synthesizing means. For example, when the well known data condensation technology such as DPCM or ADPCM is to be used, the musical sound synthesizing means 3 should be provided with the complicated functions of such condensation technology.

As shown in FIG. 8, for example, supposing the D note of the second octave is keyed with the strength of mf, and the touch information is t=10000000, and $t_5$–$t_7$ being 100, so that the contents of address (010010100) will be read out as the start address of the waveform data combination for mf of the D note of the second octave. Counter 5–30 and adder 5–20 will generate each address ADR, one step advanced from each of those read out as the start addresses, in response to the reference clock signal CLK. Eventually, waveform B, that is, the waveform for mf of the D note of the second octave which is shown in FIG. 9, will be read out sequentially from the top in response to the CLK from the ROM 1.

If the D note of the second octave is keyed with a little bit harder depression than mf, e.g., in the case of t=10000011, since $t_5$–$t_7$ are equal to those in the case of the same note being keyed with a hardness just equal to mf, the start address read out from ROM 5–10 will also take the same value as that in the case of keying in mf. However, the touch information in this case is a little bit larger than in the other case, that is to say, t=10000000 in the case of keying with just mf, instead of t=10000011 in the case of keying with a little bit harder pressing than mf. Accordingly, the output of multiplier 4 in the case of keying a little bit harder pressing than mf becomes larger than that otherwise in terms of the differential in the t values, resulting in the loudness level of the generated musical sound being larger than that in the case of mf keying.

When the configuration in the second embodiment which is shown in FIG. 6 is adopted, it will be feasible to achieve further economy of memory, compared with the case of the first embodiment. In other words, the degree of timbre variation responding to the status of the initial touch will be changeable depending upon the pitch of the tone. For example, in the case of a lower tone on a piano, the difference in timbre for each level of loudnesses from ppp to fff is comparatively large, so that combinations of waveform data have individually different timbre for each of loudness levels, and eight levels of intermediary points from ppp through fff should be prepared. On the other hand, in higher tones there are not so much differences noticed in their timbres depending upon the loudness of the musical sound being played, so that three kinds of waveform data combinations are deemed adequate. Consequently, it is feasible to decide how many kinds of waveform data combinations have to be prepared between loudness levels from ppp to fff in the case of the example shown in FIG. 6, in response to the loudness of the tone independently, which results in considerable economy of memory being available.

Next, referring to the relevant drawings, an explanation follows for the third embodiment of the invention.

Figure 10:
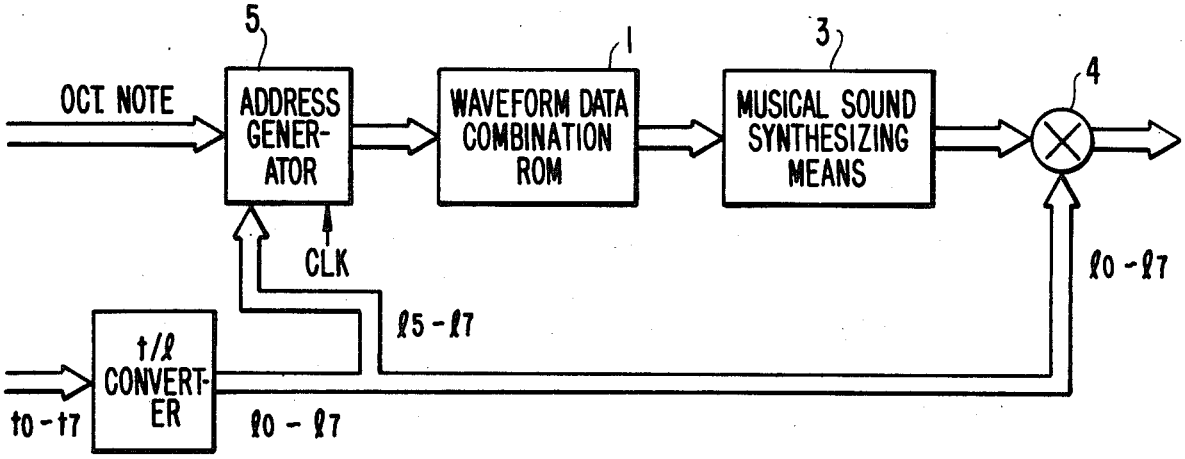
FIG. 10 is a block diagram of a sound generator for an electronic musical instrument in a third embodiment of this invention.
Figure 11:
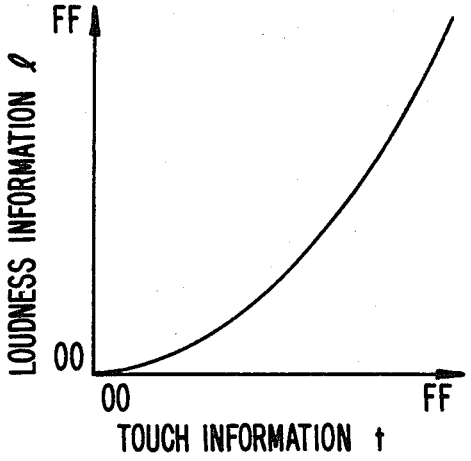
FIG. 11 is a diagram showing the relationship between the touch information and loudness information.

FIG. 10 shows a block diagram of a sound generator for an electronic musical instrument of the third embodiment of the invention. The difference from the example shown in FIG. 6 is the fact that a converter 6 located between the touch information and loudness information, (hereinafter to be referred to as a t/l converter) is provided. The touch information is a digital representation of the detected value of the keying impulse strength and keying speed, so that it will response on a one to one relationship with the loudness level. However, it is rather inconvenient for the music performance when it is used as if it were the loudness information itself. This is because the touch information t, which is dependent upon the construction of the key mechanism and the loudness level of the generated tone, are not always in a linear relationship with each other. The t/l converter 6 converts the touch information t into loudness information l, which is in a linear relationship with the loudness level, incorporating the loudness information l ($l_0$–$l_7$) alternatively in the place of the touch information t ($t_0$–$t_7$) which is given in FIG. 6. The above feature is given in FIG. 11, in that the mutual relationship, of performance is keying vs. loudness and timbre of the generated musical tone has come to be determinable optimistically. The t/l converter 6 can incorporate a ROM or decoder.

Figure 12:
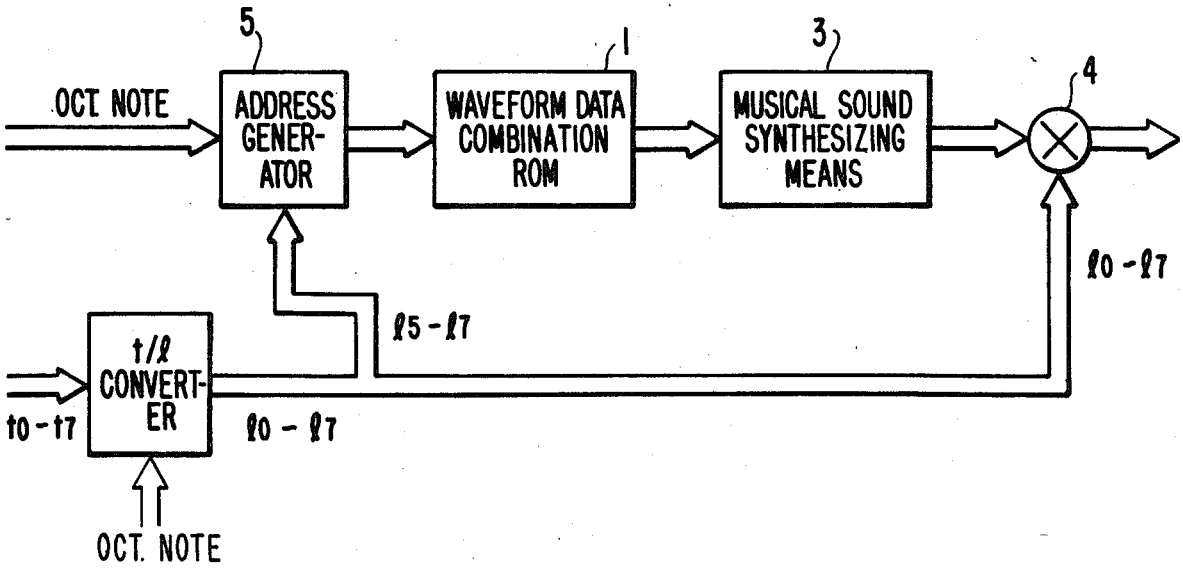
FIG. 12 is a block diagram of a sound generator for an electronic musical instrument in a fourth embodiment of this invention.

There are some occasions where it is preferable to revise the t/l relationship responding to the pitch, and an example of such case is shown as the fourth embodiment in a block diagram shown in FIG. 12, where the difference compared with the case shown in FIG. 10 is that the t/l converter 6 regulates the method of conversion in response to the given octave information OCT and note information NOTE, associated with the conversion of touch information t into loudness information l. For example, the conversion response characteristics of the t/l converter 6 may be changeable for each octave by means of incorporating both the octave information OCT and touch information t as the address input.

Next, the fifth embodiment will be illustrated referring to the relevant drawings.

In this case, the musical sound is to be synthesized depending upon a digital musical sound synthesizing method in that the musical tones are synthesized by means of interpolation from a pluarlity of waveforms. As for this kind of electronic musical instrument, a detailed description is contained within Japanese laid-open patent application No. 59-220798, "Electronic Musical Instrument", so that only a brief explanation of the outline of how to synthesize the musical tone will be given here.

Figure 13:
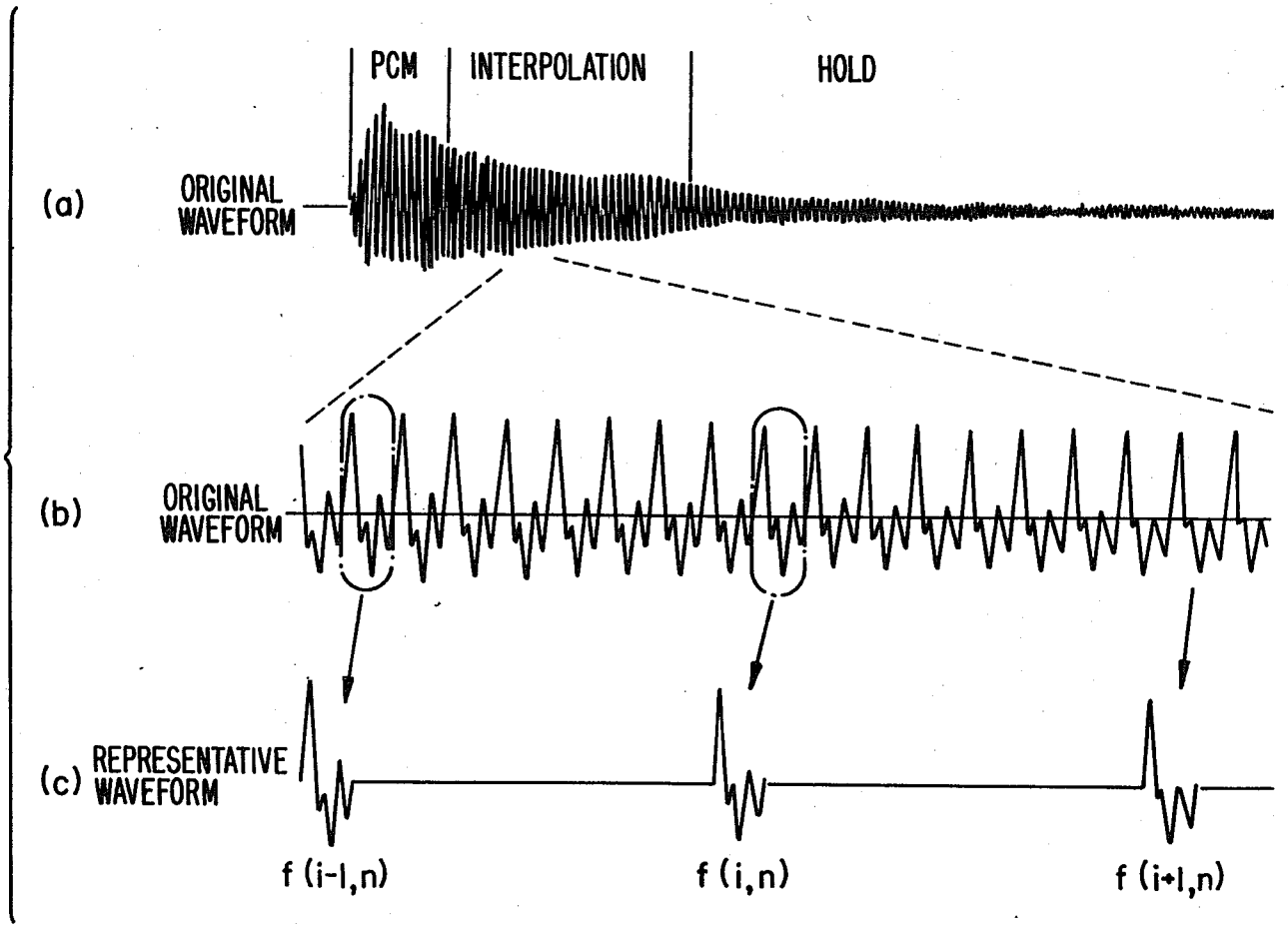
FIGS. 13(*a*)-(*c*) are waveform diagrams which are used for illustration of a musical sound synthesizing system to be incorporated for a fifth embodiment of this invention.

An actual example of piano tone waveform is shown in FIG. 13(*a*); it can be noticed that the leading part which is given identification PCM is involved with substantial variations of the waveform so that it is rather difficult to reproduce all of the values of the digital samples with high fidelity by means of interpolation, and consequently they could not help being stored into memory as they are, and read out sequentially in case of the performance. The portion labelled is given "interpolation" is given is the part where there are rather comparatively moderate variations of the waveforms, which is shown in FIG. 13(*b*) in an expanded form. From the expanded figure, it can be noticed that there exists a short period of periodicity involved with the waveforms, so that it is feasible to compress the amount of information. Some of the representative waveforms chosen from those shown in FIG. 13(*b*) are shown in FIG. 13(*c*). The waveform shown in FIG. 13(*b*) can be simulated from the waveforms shown in FIG. 13 (*c*) with very high accuracy. In this connection, the formula to be used for the interpolation is given below:

$$f(i,m,n)=f(i,n)+\{f(i+l\cdot n)\}\times(N\cdot m+n)/\{(M(i)\cdot N\}=-f(i,n)\times(1\text{-}MLP)+f(i+l,n)xMLP \quad (1)$$

where f(i, m,n): Sample of synthesized waveform f(i.n): The nth sample of the ith representative waveform M(i): Number of waveforms synthesized from the ith and the (i+1) the representative waveforms N: Number of samples included in one waveform, being the number of power of 2.

MLP: $(N\cdot m+n)/\{(M(i)\cdot N\}$

The portion labelled "Hold" in FIG. 13(*a*) is the location where there are almost no variations of the waveforms except for amplitude variations, so that this portion can be simulated by means of one waveform being read out repeatedly and the amplitude being varied.

Figure 14:
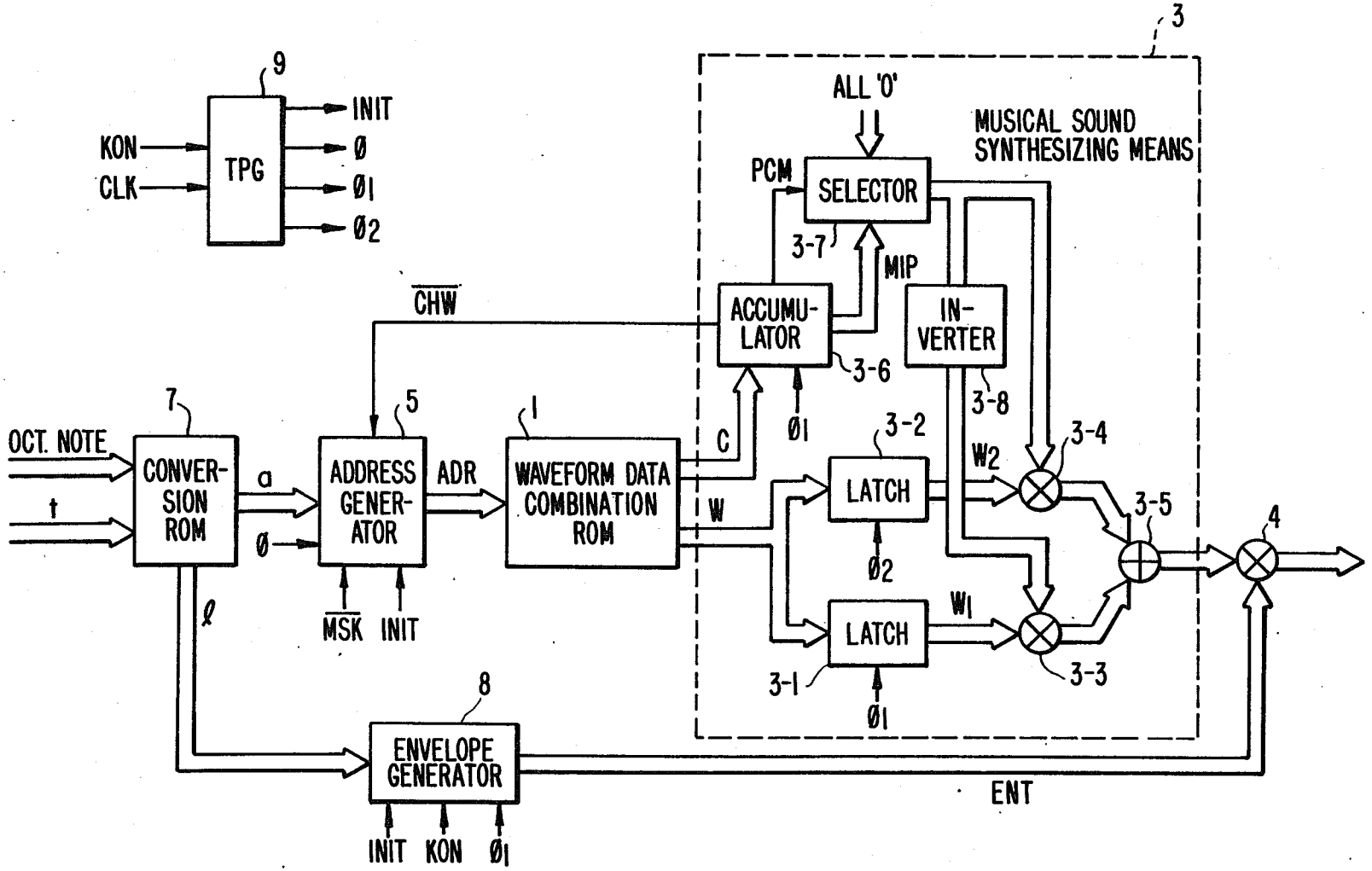
FIG. 14 is a block diagram of a sound generator for an electronic musical instrument in the fifth embodiment of this invention.

An example of a sound generator system for electronic musical instrument which is based upon the musical sound synthesizing method is shown in FIG. 14, as a configuration block diagram of the fifth embodiment of the invention. Referring to FIG. 14, 1 is a ROM for storing waveform data combinations. The waveform data combinations shown in the fifth embodiment are composed of a group of waveforms within the domain of the PCM are, a group of representative waveforms chosen from those among the interpolation range, and one waveform within the domain of the hold area. Element 3 is a musical sound synthesizing means, for executing the interpolation computation expressed by equation 1. Element 5 refers to an address generator which specifies the address of ROM 1; element 9 is a timing pulse generator (hereafter referred to as a TPG); element 7 is a conversion ROM which receives touch information t and pitch information OCT and NOTE as address inputs and otputs waveform data combinations specifying information a and loudness information l; element 4 is a multiplier, and element 8 is an envelope generator.

Figure 25:
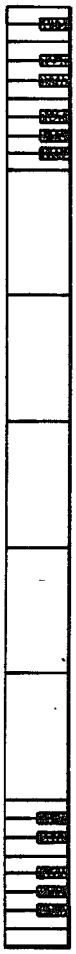
FIG. 25 is a diagram used to illustrate the octave information OCT in the fifth embodiment of the invention.

The operation of the fifth embodiment of the invention which has a configuration as mentioned above will be explained as follows. Referring to FIG. 14, OCT and NOTE represent the octave information and note information respectively as in the case shown in FIG. 3. However, in this case, musical tones stretching over a wide range of octaves equivalent to the 88 keyboard of a piano are obtained. Consequently, the octave information OCT is widened to a 4 bit range. The octave numbers corresponding to the octave information are shown in FIG. 25.

The touch information t is referred to 4 bit binary data which represents the strength and speed of the key depression in terms of 16 levels, in which t='0'X stands for the softest depression given on the key, and on the other hand, t 'F'X stands for the status where the key is depressed with the strongest compression. The contents of the conversion ROM 7 for the piano are given in FIG. 15 (in which the numerals are given as hexa decimal digits).

Figure 16:
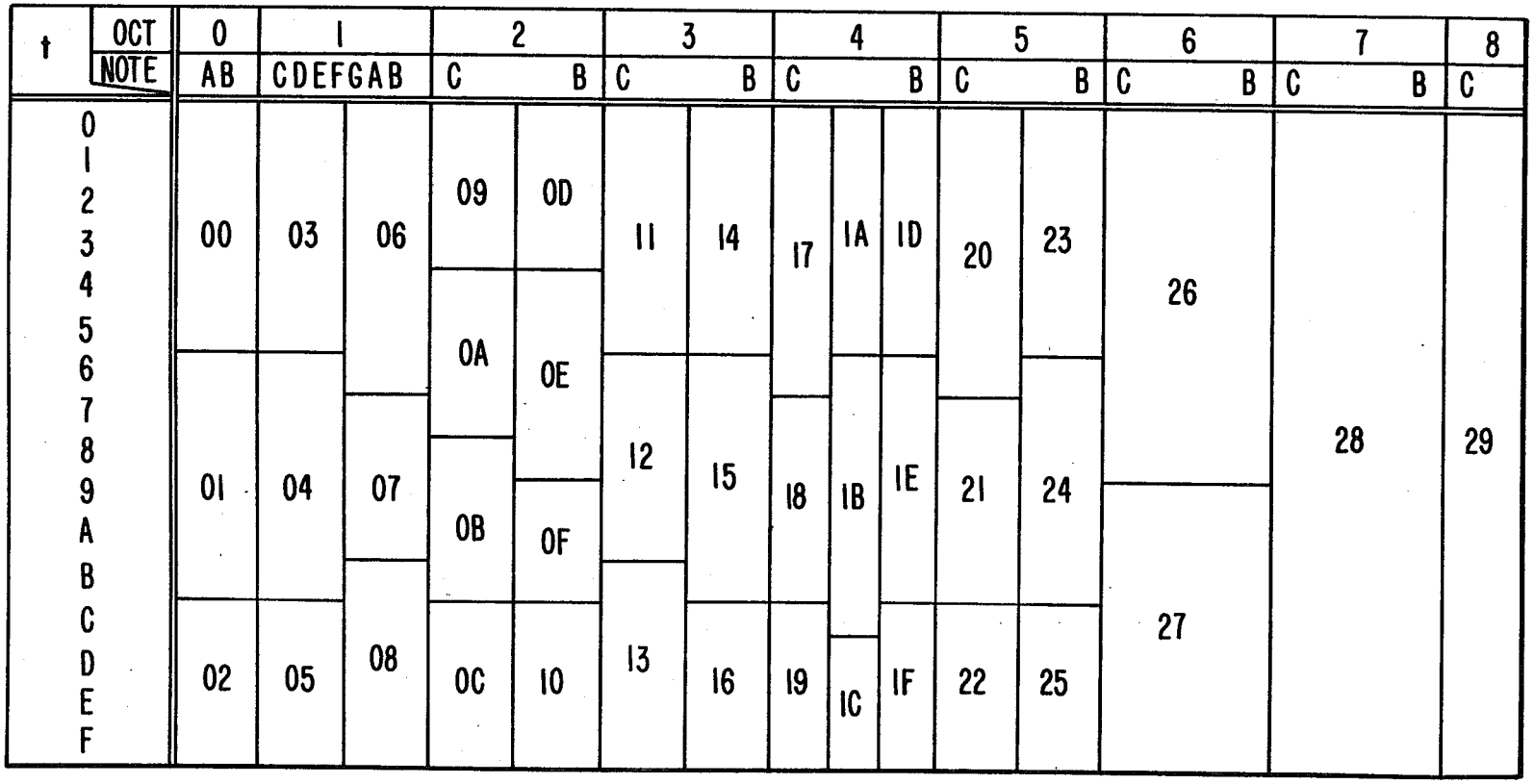
FIG. 16 is a diagram showing allocation of waveform data combination specification information in the case of the fifth embodiment of this invention.

In FIG. 15, the case, where OCT=4 and NOTE=0 has OCT and NOTE representing the middle C note (261.6 Hz). OCT and NOTE are allocated to the upper bits of the address data, and t is allocated to the lower bits of the address data. The allocations of waveform data combination specifying information a is shown in FIG. 16. As shown in FIG. 16, in this example '29'X pieces, i.e., 42 pieces of data combinations are prepared for this waveform combinations.

Figure 26:
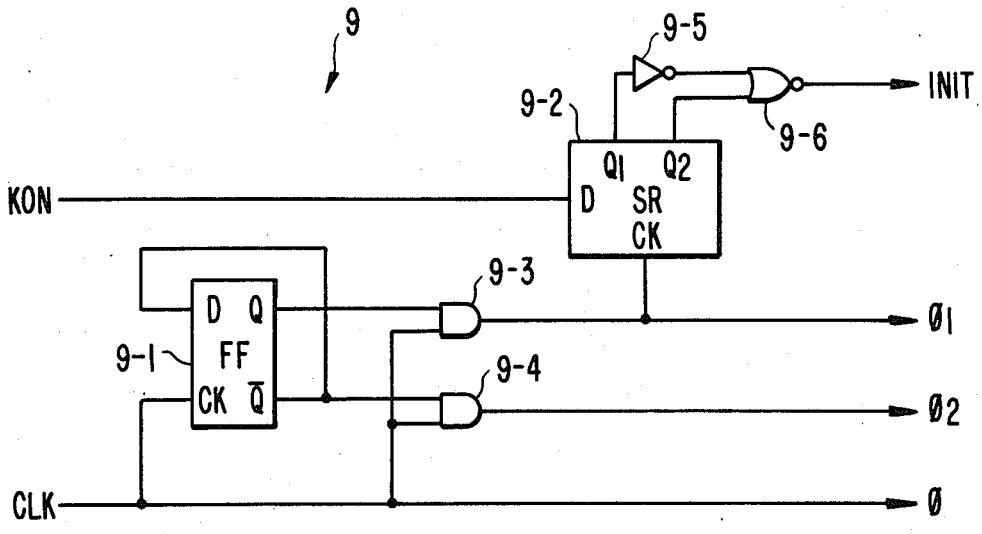
FIG. 26 is a configuration diagram of the timing pulse generator (9)
Figure 27:
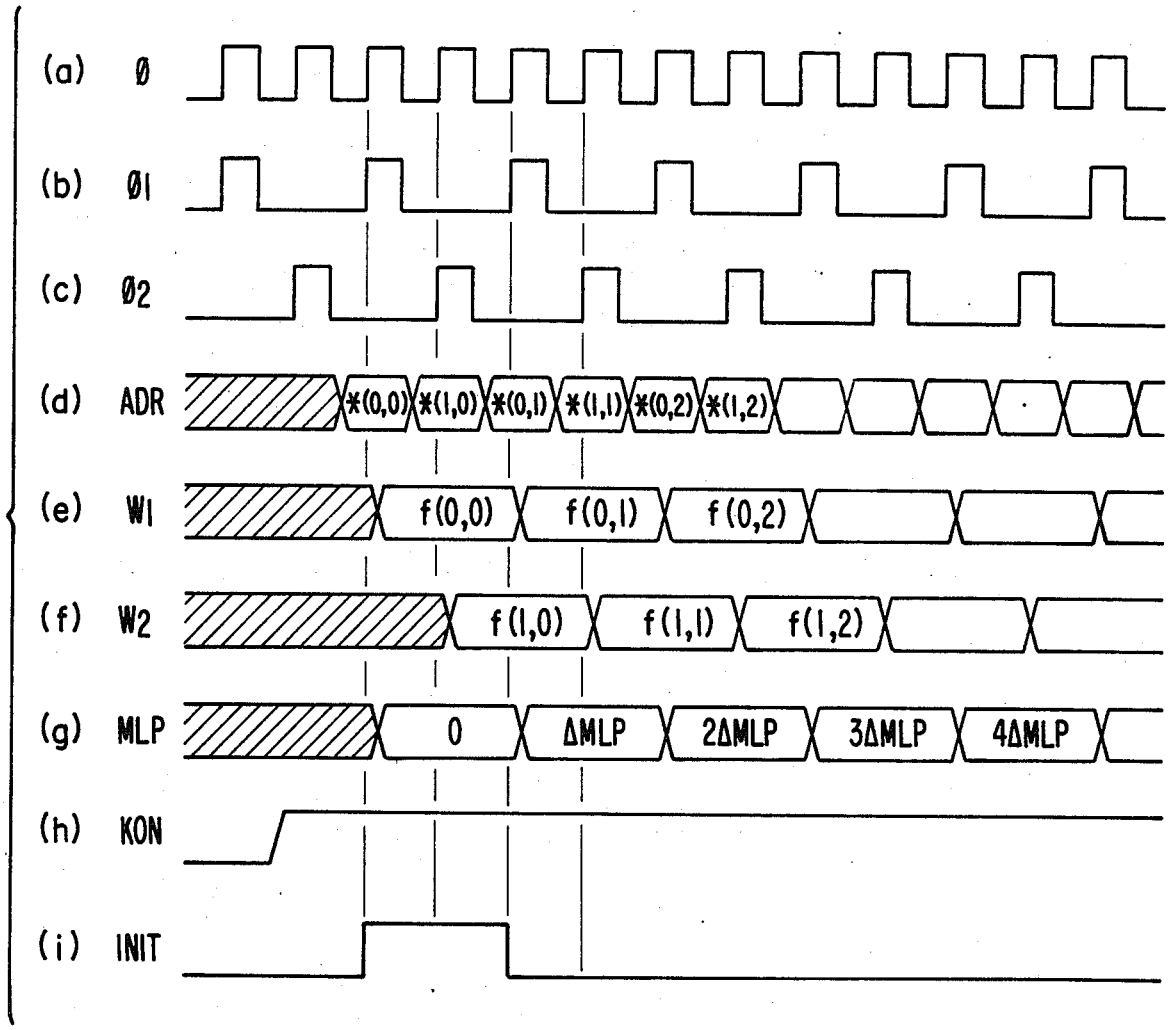
FIGS. 27(*a*)-(*i*) are is an operation timing diagram in the fifth embodiment of the invention.

In FIG. 15, the fourth octave, in that OCT=4, at the center of pitch range, is divided into 3 groups in terms of notes, while the other octaves are divided into one or two groups in terms of notes. This is because, in the piano tones, there are comparatively large differences between the adjacent notes at the central octave part. The waveform data combination for each of plural numbers of divided groups is prepared so as to make the differences between tones hardly to noticed at the time of simultaneous or continuous playing at different pitches. Contrary to the above, the highest 3 octaves can be repesented by the same waveform data, regardless of which one of twelve notes contained in these octaves is being played, as long as they are played with the same strength. Furthermore, for the twelve notes of the seventh octave, regardless of how strongly one of the keys is played, they are all represented by a waveform data combination corresponding to a='28'X. That is to say, the same waveform data combination can be incorporated invariably, regardless of whether the seventh octave C note key is depressed with a strength corresponding to t='0'X or the seven octave B note key is depressed with a strength corresponding to t='F'X. The differences between the above two cases are the frequency and loudness level of the generated sound. TPG 9 shown in FIG. 14 generates timing signals, INIT, $\phi$, $\phi_1$ and $\phi_2$, which specify the timing of the overall operation of the sound generator. An example of configuration of the TPG 9 is shown in FIG. 26, where element 9-1 is a D-Flip Flop; element 9-2 is a shift register; element 9-3 and 9-4 are AND gates, and elements 9-5 and 9-6 are an inverter and a NOR gate respectively. The signal timing diagrams in TPG 9 in the configuration shown in FIG. 26 are shown in FIGS. 27 (*a*), (*b*), (*c*), (*h*) and (*i*).

Figure 17:
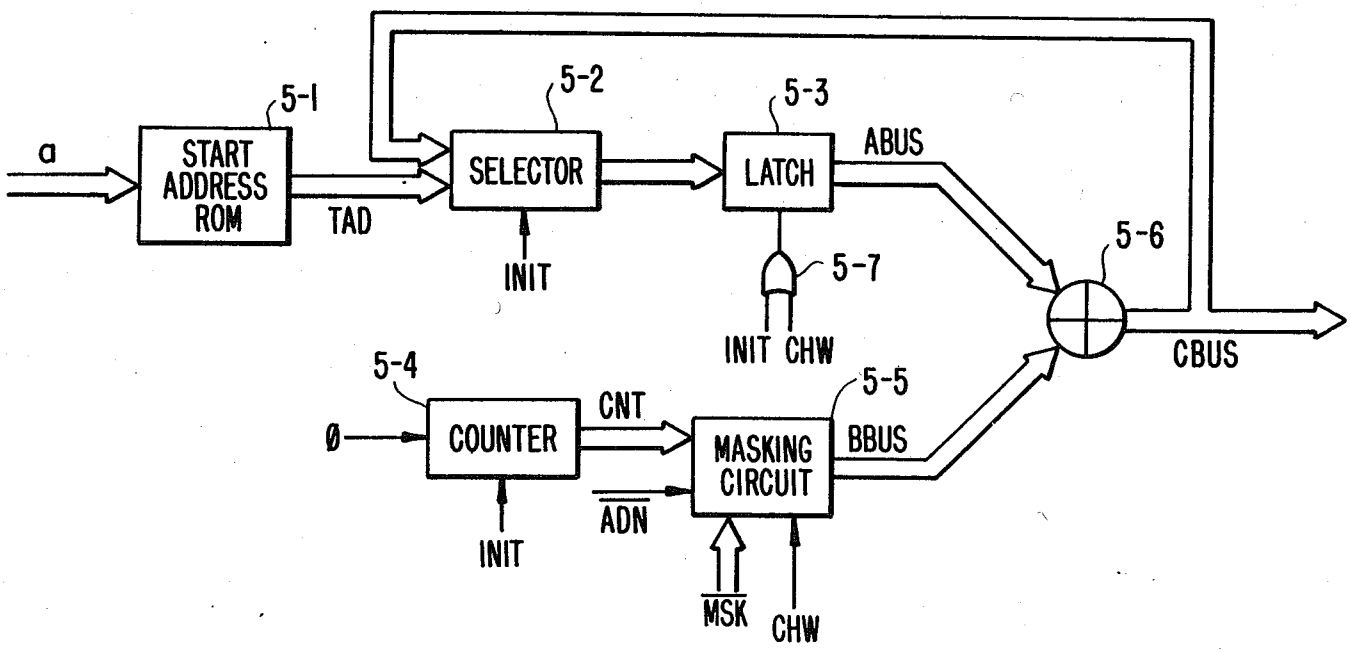
FIG. 17 is a configuration diagram of an address generator which is given in FIG. 14.
Figure 28:
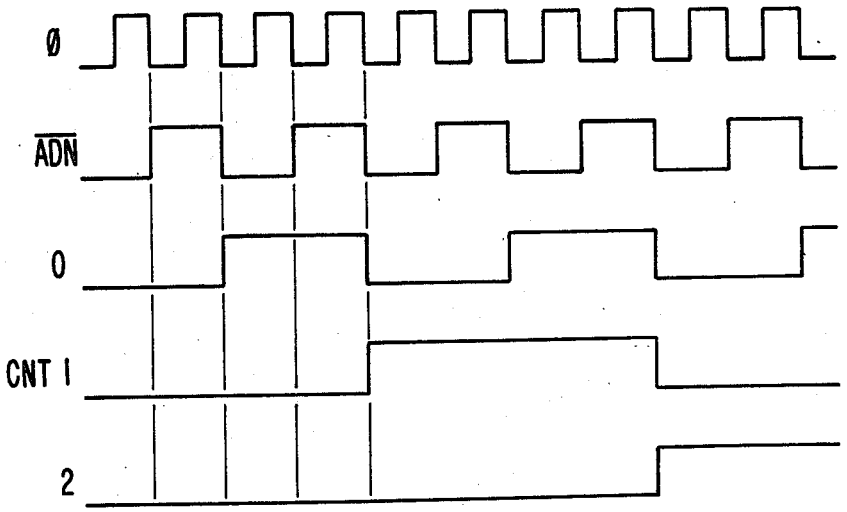
FIG. 28 is a timing diagram of the counter (5-4)

Next, the method of waveform synthesis will be explained sequentially. Taking the octave information OCT, note information NOTE and touch information t as address inputs, the waveform data combination specifying information a and loudness information l are read out. The waveform data combination specifying information a, which is read out the conversion ROM 7 will be inputted into the address generator 5. A configuration of the address generator 5 is shown in FIG. 17, where the start address ROM 5-1, taking waveform data combination specifying information a as an address input, stores the start address data TAD in ROM 1 of the waveform data combination which has been specified by a, and outputs the start address data TAD in response to an input. The start address ROM 5-1 contents are shown in FIG. 18, where numerical values in the vacent columns are eliminated. Selector 5-2 will select the start address data TAD according to the INIT signal which prompts the initial setting of the musical sound synthesis, feeding it to latch 5-3. The latch 5-3 will latch the start address data TAD on the basis of the INIT signal, and send it to ABUS. Counter 5-4 is a binary counter of eleven bits, which executes counting at a speed in response to the waveforms data read out speed, and which is initialized by INIT signal, letting numeral counting start from the status where all bits are '0'. The signal timing of counter 5-4 is shown in FIG. 28. in which CNT3–CNT9 are eliminated. Masking circuit 5-5 will mask the bit specified ROM among the outputs of counter 5-4. Accordingly, masking circuit 5-5 and counter 5-4 form a programmable counter.

Figure 19:
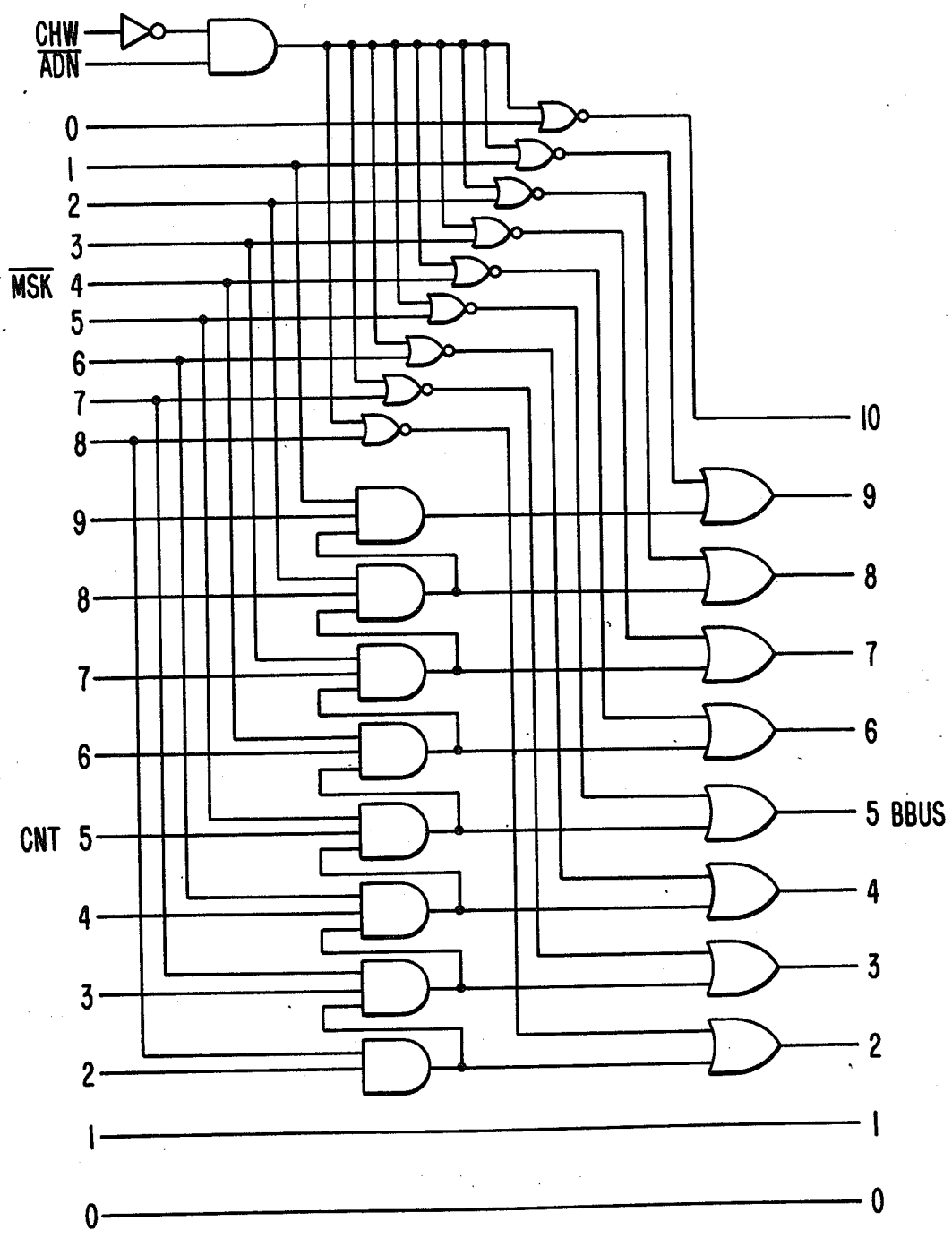
FIG. 19 is a configuration diagram of a masking circuit which is given in FIG. 17.
Figures 20, 22:
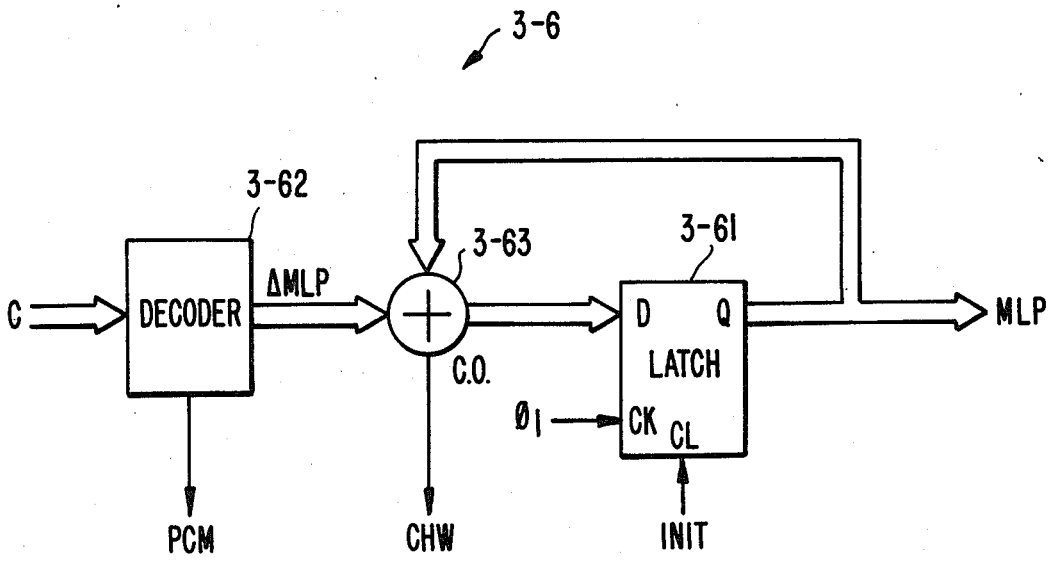
FIG. 20 is a diagram showing the relationships among the octave number, the number of samples in one waveform, and the mask signal $\overline{MSK}$.
FIG. 22 is a confifguration diagram of an accumulator given in FIG. 14.
Figure 29:
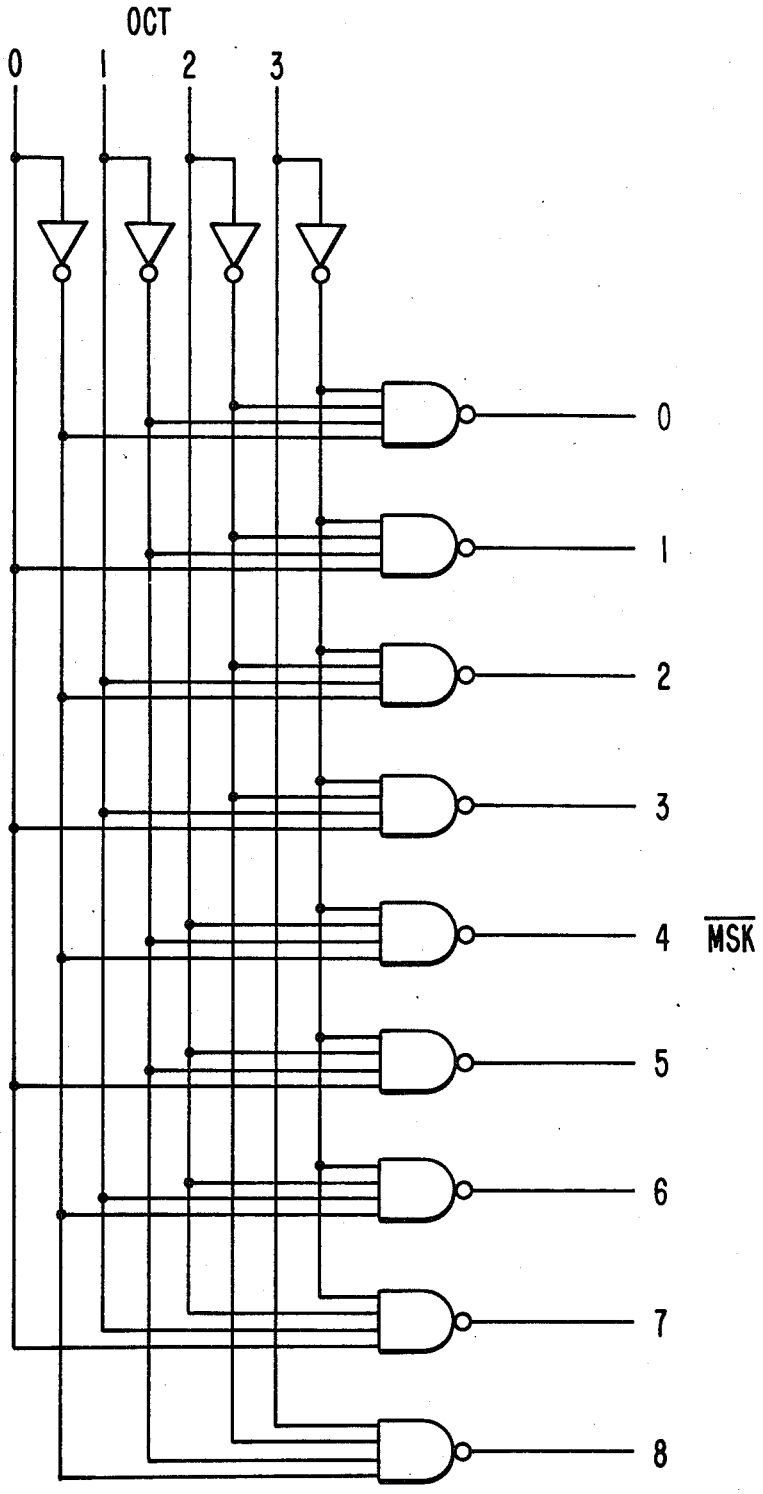
FIG. 29 is a circuit diagram of the $\overline{MSK}$ signal generator.

An example of masking circuit 5-5 is shown in FIG. 19, where $\overline{MSK}$ is the data generated from octave information, by which the mask bits will be specified. An example of the mask information ($\overline{MSK}$) generating circuit is shown in FIG. 29, and the relationship between octave information OCT and mask information $\overline{MSK}$ is shown in FIG. 20. CHW is generated by accumulator 3-6, being the signal prompting the replacement of a waveform, and being '0' exclusively in the case of a waveform replacement. In the case of octave No. 4 being the center octave, as shown in FIG. 20, $\overline{MSK}$ 4 only is '0', exclusively and the other bits are '1', so that CNT6–CNT9 from among CNT0–CNT9 in FIG. 19 will be masked, and count values, CNT0–CNT5 only being transmitted to the BBUS, and CNT6–CNT9 being '0'. Consequently, in spite of counter 5-4 repeating counting with a 10 bit width, the data on the BBUS will be counting a value of the 6 bit width occurring repeatedly. $\overline{MSK}$ will be decided by octave No. unanimously, because of the fact that the number of samples N of the representative waveform f(i, n), which is shown in FIG. 13 or expressed by formula (1) is changeable in response to the octave. Concretely, N is chosen as shown in FIG. 20, and $\overline{MSK}$ is so specified that N is to be counted by means of counter 5-4 and mask circuit 5-5. In reality, in the case of synthesizing a tone belonging to the ith octave, the counter which is to count the required N can be composed by means of the ith bit, i.e., $\overline{MSK}$ i being set to '0' exclusively, and the other bits being set to '1'. An example of a circuit which generates the $\overline{MSK}$ signal is shown in FIG. 29. In this way, the BBUS will display repeatedly the value counting N, and this count value is fed to adder 5-6, where is is added to the start address data TAD which is stored in latch 5-3 shown in FIG. 17, being outputted to the CBUS, so as to thereby generate the read-out address of waveform data combination ROM 1. Further the operation of addition of N by means of OR gates, shown in FIG. 19 is repeated periodically be means of signal $\overline{ADN}$ having $\frac{1}{2}$ cycle of the counting frequency of counter 5-4. Count values of 2N pieces, i.e., O, N, 1, 1+N, 2, 2+n, . . . N-1, and 2N-1, will appear in sequential order on the BBUS. Consequently, on CBUS, as an output of address generator 5 shown in FIG. 17, 2N pieces of address values will be generated in sequential order, in that the values are adr, adr+N, adr+1, adr+1+N, adr+2, adr+2+N, . . . , adr+N−1, and adr+2N−1, where adr represents the address stored in latch 5-3.

On the other hand, CHW will be generated by accumulator 3-6 shown in FIG. 14, and masking circuit 5-5 shown in FIG. 17 will open the NOR gates shown in FIG. 19, when CHW=1. The count value on the BBUS will be the value resulting from the addition of N to the count value hitherto obtained, the sum being latched eventually by means of latch 5-3 shown in FIG. 17. The output CBUS of adder 5-6 hereafter, does not maintain CHW='0', but outputs an address value which is larger by N that the address value issued previously. This series of operations means that the two waveforms f(i, n) and f(i+1, n) which are incorporated in the interpolation that is explained in the formula (1), have been revised into f(i+1, n) and f(i+2, n).

From the above descriptions, it will be clear that, when a waveform is synthesized from f(in, n) and f(i+1, n), the value *(i, o) will be stored in latch 5-3. The contents of waveform data combination ROM 1 are shown in FIG. 21, where *(i, n) is referred to the address data of the nth sample of the ith waveform, and consequently *(i, N−1) is to be the address of the last sample of the ith waveform, *(i+1, o) being the address of the first of the (i+1) the sample.

Each of the data consists of 16 bits, in which the upper 12 bits are waveform data W, and the lower 4 bits are control data C. The control data C which is stored in *(i, n) is to control how to deal with the two waveform data f(i, n) and f(i−1, n) which are read out simultaneously. The control data C is decoded by a decoder included in the accumulator 3-6 shown in FIG. 14, eventually deciding the operation of the musical sound synthesizing means 3.

The configuration of accumulator 3-6 is shown in FIG. 22, in which the decoder 3-62 which is incorporated in the accumulator 3-6 will decode the control data C to generate ΔMLP. The decoded value ΔMLP will be accumulated by adder 3-63 and latch 3-61, so as to eventually generate and output MLP. The MLP revision timing is shown in FIG. 27(*g*). The MLP corresponds directly to MLP which is given in formula (1). The relationship between the control data C and its decoded value ΔMLP is shown in FIG. 23. The decoder 3-62 incorporated in accumulator 3-6 generates a PCM signal exclusively when the control data C is 'F'X, and the PCM signal will replace all of the output MLP of accumulator 3-6 by a '0' signal. Accumulator 3-6 wll output a CHW signal when the result of accumulation conducted by accumulator 3-6 overflows the ly bits of the output MLP. CHW incorporates the carry-out signal of adder 3-63, and is utilized for waveform revision by means of the address generator 5 shown in FIG. 17.

Figure 21:
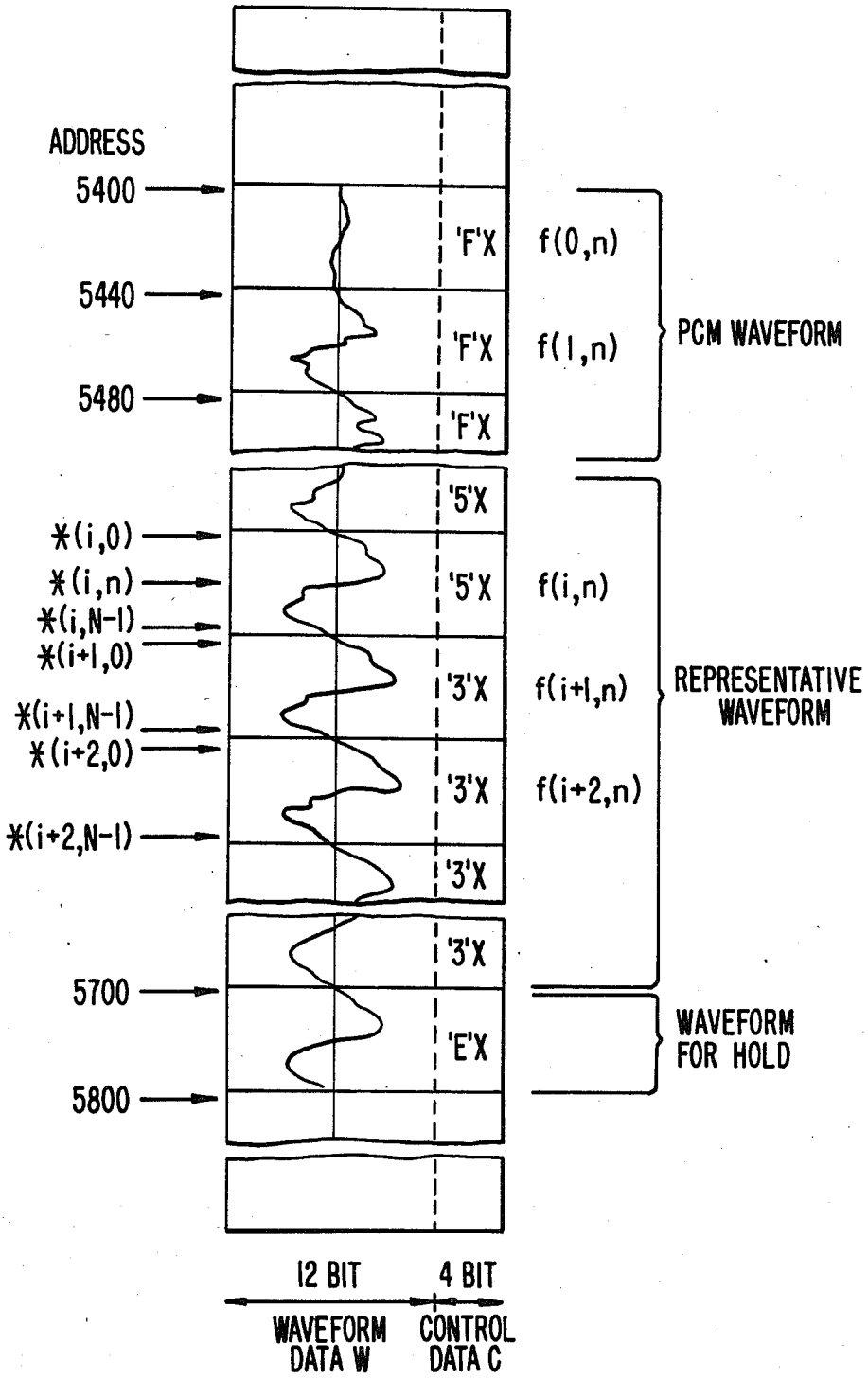
FIG. 21 is a diagram showing the contents of a waveform data combination ROM in the fifth embodiment.

Address '5400'X, which is shown in FIG. 21, is the start address data TAD which is used when the middle C note is played loudly, as evident from FIG. 15, FIG. 16 and FIG. 18. Consequently, when the middle C note is played loudly, latch 503 shown in FIG. 17 will latch '5400'X first. By the operation of the address generator 5 shown in FIG. 17, a couple of f(0, n) and f(1, n), the former from address '5400'X and the latter from address '5800'X, separated in terms of N=64 samples, will read out sequentially along with a revised n. The address signal timing should refer to FIG. 27(*d*). Synchronizing the operation of the reading out of the couple of f(0, n) and f(1, n), adder 3-63 incorporated in accumulator 3-6 in FIG. 22 will execute an accumulation of ΔMLP, which may be seen in FIG. 27(*g*). Referring to FIG. 21, all of the control data C corresponding to the above couples of 64 pieces of waveform samples are 'F'X. Consequently, in the case of middle C, ΔMLP will be $2^{6+4}=2^{10}$, because OCT=4. Since accumulator 3-6 has a 16 bit width, $2^{18}\div 2^{10}=64$, and as a result, one reading out of a couple of f(0, n) and f(1, 0) wll let adder 3-63 overflow so as to generate CHW, being followed by a subsequent reading out of a couple of f(1, n) and f(2, n), to be subjected to an interpolation calculation.

The read-out waveform samples will be temporarily stored in latch 3-1 and latch 3-2, which are shown in FIG. 14, respectively, in response to $\phi_1$ and $\phi_2$. The revision timing of the waveform data which are temporarily stored in latches 3-1 and 3-2 are given in FIGS. 27(*e*) and 27(*f*). With one side of these waveform samples, i.e., f(i+1, n), the output of selector 3-7, MLP, will be multiplied by means of multiplier 3-4, and with the other one, f(i, n), (1-MLP), which is obtained from MLP and inverted by the inverter 3-8 is multiplied by multiplier 3-3. Outputs of these multipliers 3-3 and 3-4 are added by adder 3-5 so that f(i, m, n) in formula (1) can be obtained. As for the couple of f(0, n) and f(1, n), the control data C is 'F'X, so that accumulator 3-6 will generate a PCM signal, and selector 3-7 supplies '0' signals for all of the bits to multiplier 3-4 and invertor 3-8, as its output MLP. As the result, the output of multiplier 3-3 is f(0, n) as MLP, multiplied by all '1', and the output of multiplier 3-4 will be virtually 0 in place of f(1, n), so that adder 3-5 will output substantially the same value to f(0, n).

In the following, a description will be given on the advanced stage of waveform synthesis, i.e., waveform synthesizing by f(i, n) and f(i+1, n). *(i, 0) has been stored in latch 5-3 shown in FIG. 17. Address generator 5 in FIG. 17 will output *(i, n) and *(i+1, n) alternately, which are the addresses of samples of f(i, n) and f(i+1, n) respectively in sequential order. Waveform data combination ROM 1 will output f(i, n) and f(i+1, n) sequentially, which are latched by latch 3-1 and 3-2 shown in FIG. 14, respectively. Accumulator 3-6 shown in FIG. 23 decodes '5'X of the control data C to accumulate '20'X. Since the bit width of accumulator 3-6 is 16 bits, after $2^{16}\div$'20'X, i.e. $2^{16}\div 2^5=2^{11}=2048$ pieces of waveform samples are synthesized, accumulator 3-6 will overflow to generate CHW, whereby waveform revision is executed. That is to say, 32 synthesized waveforms will be outputted by interpolation of f(i, n) and f(i+1, n). Subsequently, 128 synthesized waveforms will be outputted as it can be understood by the fact that control data C is '3'X, in two waveforms of f(i+1, n) and f(i+2, n).

When the synthesis of waveforms is further advanced up to the stage where music tones are synthesized from waveforms for holding and waveform data subsequent to those in the ROM, accumulation of MLP data will be stopped by 'E'X of control data C, so the output of accumulator 3-6 will invariably be all '0'. Consequently, accumulator 3-5 will output repeatedly the holding waveform as is. Here, waveform revision will not take place, because there is no overflowing of accumulator 3-7.

Figure 24:
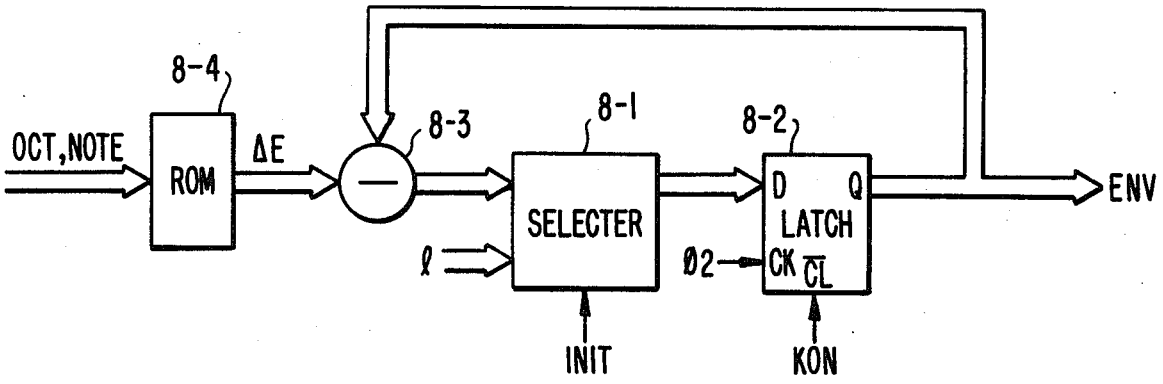
FIG. 24 is a configuration diagram of an envelope generator.

Envelope generator 8 generates envelope information ENV which is decaying along with progress of time from the initial value which is taken of the output of ROM 7, i.e. loudness information l. The envelope information ENV will be multiplied by the output of adder 3-5 at multiplier 4, i.e., the result of calculation f(i, n, n) of interpolation, to finally obtain the synthesized musical sound waveforms. In order to meet the above purpose, the waveform data shown in FIG. 21 have been compensated with respect to their amplitude beforehand under the consideration of diminishing envelope information to be multiplied. This compensating operation will effect for waveform data to be reducted on their amplitude diminution to be stored in waveform data combination ROM 1, so that the number of bits which are used for memory can be improved effectively on their utilization. A configuration example of an envelope generator 8 is shown in FIG. 24, where selector 8-1 will select loudness information l responding to INIT signal, and feeds it as the initial value to latch 8-2 with a timing of $\phi_2$ to be stored temporarily, and thereafter reduces it step by step by ΔE and eventually outputs it as envelope information. ΔE is obtained by decoding OCT information and NOTE information. The envelope information will be sequentially latched by latch 8-2 through selector 8-1. When the key if off, KON signal is 'LOW', letting latch 8-2 be cleared, and letting the ENV output be '0'. Such an envelope generator is disclosed in detail in Japanese laid-open patent application No. 58-200295 entitled 'Envelope Adding Apparatus'.

According to the fifth embodiment, there is provided a conversion table which is used for the determination of waveform data combinations, which are to be incorporated for music synthesis in response to loudness information and touch information, and the generated sound loudness level of the synthesizes waveform. Accordingly, the waveform data combination to be used for synthesis and the playback sound loudness level can be specified optionally and independently. That is to say, very natural touch response feeling can be achieved. Furthermore, as an example of the conversion table mentioned above, a configuration is shown in FIG. 15, in which each loudness is provided with conversion data. In this connection, it is feasible to reduce the size of the conversion table by means of bundling pitch information into several groups. Also, in order to simulate a plurality of musical instrument outputs, each of the waveform data combination ROM 1 may be provided with each of the individual waveform data suitable for the tone of the plurality of musical instruments. It will be feasible to emphasize the more appropriate touch response feeling if conversion ROM 7 is also provided with a particular conversion table for each individual musical instrument. It is also allowed to store the start address data TAD contained in waveform data combination ROM 1 directly in place of waveform data combination specifying information alternatively. In this case, the start address ROM 5-1 shown in FIG. 17 can be removed.

Figure 30:
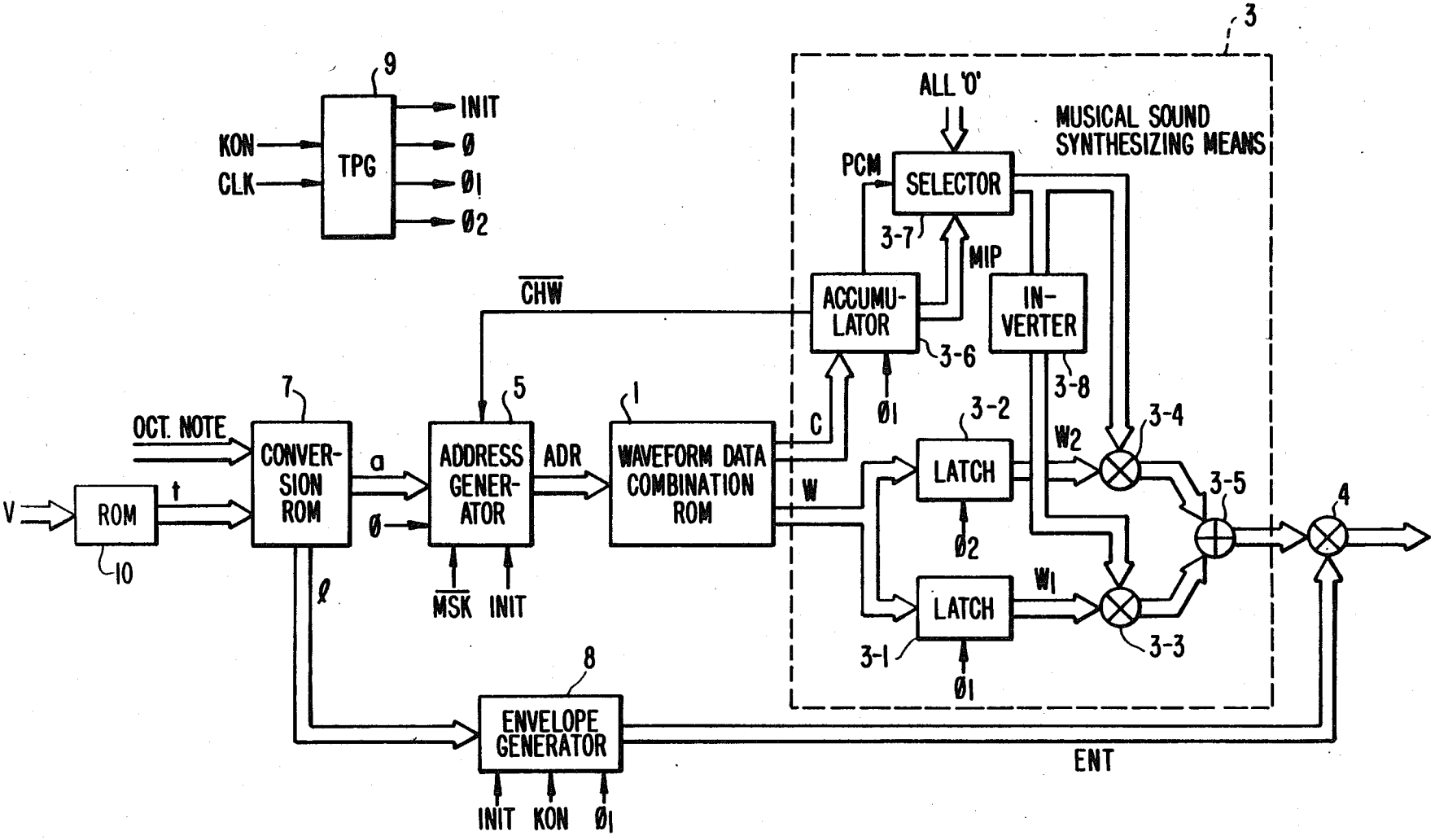
FIG. 30 is a block diagram of a sound generator for an electronic musical instrument in a sixth embodiment of the invention.

Next, a sixth embodiment will be described, referring to the relevant drawings. FIG. 30 shows a block diagram of the sixth embodiment of the invention, where the difference as compared with the embodiment shown in FIG. 14 is the fact that ROM 10 is supplemented. The information which has been given as touch information t in the previous examples, is, e.g., the information which is obtained by counting the keying speed in terms of the counting of the open/close operation time of the transfer switches. In the sixth embodiment, it should be referred to as keying speed information v.

ROM 10 receives keying speed information v as an address input and reads out touch information t to feed it to ROM 7. ROM 10 will convert a 7 bit width of keying speed information v into a 4 bit width of touch information t. The bit width of touch information t is chosen as 4 as the minimum number required for representation of a musical sound, so that the player can distinguish the tunes of his performance within a range of loudness or timbre of $2^4=16$ level from the soft-test to the loudest tones. On the other hand, keying speed information v is chosen to have a 7 bit width, which is, e.g., the information obtained by the method of measuring the time required for a transfer switch open/close operation, which is caused by the keying operation, etc. Consequently, v can express $2^7=128$ full ways of keying speeds. However, the above could not help being called a somewhat excessive specification, because the player could not play the tunes with high accuracy dividing into 128 levels as for the range of ppp to fff. As mentioned previously, ROM 10 will convert v of a 7 bit width into t of a 4 bit width, cutting off the excessive specification. However, it is not in vain that bit width of v is 7 bits wide, because the value of v will be changeable variously depending upon the construction of the keyboard, the method of speed detection and its device. That is to say, the player could not play to produce the same value of v even if he were able to depress the same keyboard with the same speed, according to the variations of detecting methods and devices. ROM 10 functions at the same time for the touch information not to be effected by variation of detected value v of the keying speed, involved with differences in the keyboard construction or keying speed detecting device. In other words, when the keyboard construction is revised, if ROM 10 is revised exclusively, it is feasible to maintain almost the same status of mutual relationship between the keying speed, and both of loudness and timbre of the generated tone before and after the keyboard revision. Consequently, it is required for the bit width of v to be much wider than that of t.

As seen from the description given above, it is clear that the revision of the keyboard construction or keying speed detecting device can be responded to exclusively by merely revising the contents of the conversion ROM, because of the fact that the conversion ROM is provided for this embodiment, width can convert the keying speed information which is changeable in a wide range by means of the variations of keyboard construction or keying speed detecting method or device into touch information which is invariable regardless of any keyboard construction or keying speed detecting device given. Hereafter, the method of conversion of keying speed information v into touch information t is often to be referred to as a v/t converter.

Next, a seventh embodiment of the invention will be described, referring to the relevant drawings.

Figure 31A:
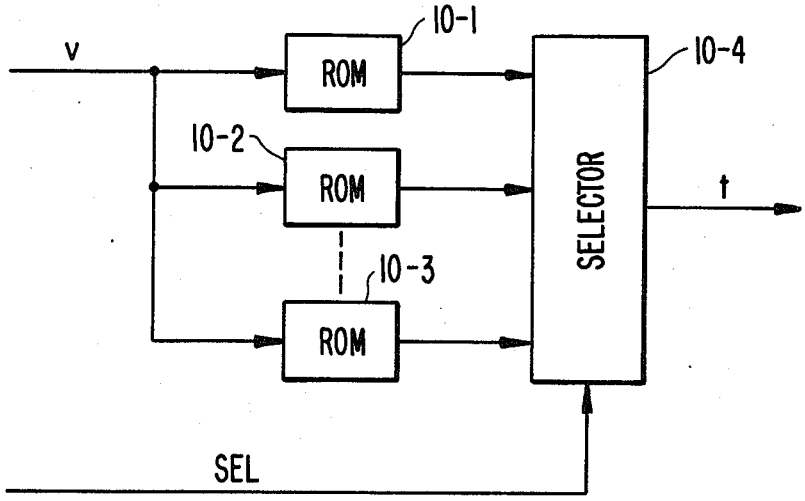
FIGS. 31(*a*)-(*b*) are block diagrams of v/t convertors to be incorporated in a seventh embodiment of the invention.
Figure 31B:
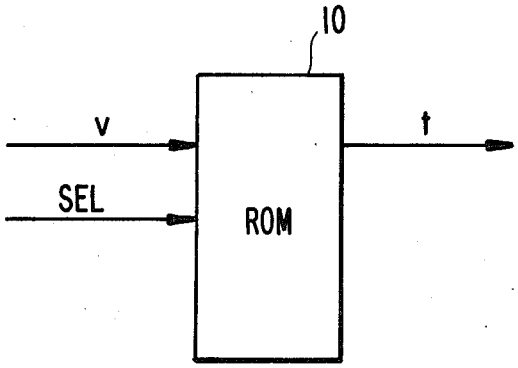

FIGS. 31(*a*)–31(*b*) are v/t converter block diagrams of converters which may be incorporated in the seventh embodiment of the invention, where v and t are the keying speed information and touch information respectively and are the same as those given in the embodiment in FIG. 30. The point of difference between the seventh embodiment and that shown in FIG. 30 is nothing but the ROM 10 shown in FIG. 30 being replaced by the v/t converter which is shown in FIG. 31(*a*) or (*b*), so that the other parts of illustration or explanation will be omitted. There are a plurality of ROMs, i.e., ROM 10-1, ROM 10-2, ROM 10-3, and so on in FIG. 31(*a*), which converts the seven bit width of v into the 4 bit width of t, so that more than one numbers of t are read out in response to one of v. Element 10-4 is a selector which selects one of the value of ts which have been read out simultaneously by means of select information SEL which selects the characteristics of the v/t converter. The select information SEL is generated by a switch circuit which is e.g., manipulates by the player. In the case of FIG. 31(*b*), ROM 10 is provided with keying speed information v and select information SEL as address signals. In ROM 10, more than one of the v/t conversion characteristics are stored, in that the various vit conversion characteristics available by selecting from among select information SEL in the same way as shown in FIG. 31(*a*).

The player's self selection of the touch response may be available by the incorporation of the above configuration.

In the foregoing, some embodiments of the invention have been described, which are shown in FIG. 3, FIG. 6, FIG. 10, FIG. 12, FIG. 14, FIG. 30 and FIGS. 31(*a*-)–31(*b*). It has been disclosed that there are two ways of synthesizing, namely, one method in which the digital values which can be obtained by digitizing the musical sound waveforms as waveform data combinations as they are, and the other one in which the musical sounds are recomposed by interpolation from a plurality of representative waveforms which have been selected and stored in a memory preliminarily. In this connection, these methods can be condensed further by means of some condensation technology, where it will be required to utilize each of the multiplication devices for the musical sound synthesis means. Beside the above, there are other means of musical sound synthesis available, such as the well known method of sinusoidal wave addition or frequency modulation, in which parameters that are used for thse methods of synthesis should be prepared for the waveform data combination. It goes without saying that, as for musical sound synthesizing means 3, the sinusoidal wave adding type musical sound synthesizer or frequency modulation type musical sound synthesizer may incorporated.

Instead of an ROM or decoder being used for the t/l converter 6 in FIG. 10 and FIG. 12, or the v/t converter 10 in FIG. 30, a microprocessor may be used to execute the arithmetic operation to obtain the value of conversion. As one of such examples, the conversion characteristics shown in FIG. 10 will be simulated by a number of line segments, a linear equation being solved on each of the line segments to get the result, or the incline of each line segment is represented by a value of increment, the conversion value being obtained by accumulation of each of the increments.

In the embodiments shown in FIG. 3 through FIGS. 31(*a*)–31(*b*), ROMs are used as a plurality of configuration elements. However, these ROMs are, obviously, able to be disposed in different zones of the same package.

What is claimed is:

1. A sound generator for an electronic musical instrument, comprising:

a keyboard;

a memory means for storing a plurality of waveform data combinations each of which represents a waveform obtained from a natural sound;

a selection means for decoding a keyboard information from said keyboard into an address signal for said memory means so as to thereby select one of said plurality of waveform data combinations, said keyboard information including at least a touch information which represents at least one of a depressing speed and a depressing strength of a key of said keyboard;

a tone generating means for generating a tone from an output of said memory means; and a loudness control means for controlling loudness level of the generated tone in response to said touch information.

2. A sound generator according to claim 1, wherein each of said waveforms is obtained from a natural sound generated by a natural musical instrument.

3. A sound generator according to claim 1, wherein each of said waveforms data combinations is obtained by digital conversion of partial or total continuum from generation to diminuation of a single tone from among a plurality of tones generated by a natural musical instrument played in different loudnesses at a plurality of selected pitches.

4. A sound generator according to claim 1, wherein each of said waveform data combinations consists of a plurality of digital data each having a same data length which represent respective levels of said waveform, a maximum level of said waveform being represented by a maximum value expressable within said data length.

5. A sound generator according to claim 1, wherein said keyboard information further includes a pitch information.

6. A sound generator according to claim 1, wherein said selection means comprises a read only memory.

7. A sound generator for an electronic musical instrument, comprising:

a keyboard;

a memory means for storing a plurality of waveform data combinations each of which represents a waveform obtained from a natural sound;

a waveform and loudness specifying means which generates an address signal for said memory means and a loudness information by decoding a keyboard information from said keyboard, said keyboard information including at least a touch information which represents at least one of a depressing speed and a depressing strength of a key of said keyboard;

a tone generating means for generating a tone from an output of said memory means; and a loudness control means for controlling loudness level of the generated tone in response to said loudness information.

8. A sound generator according to claim 7, wherein each of said waveforms is obtained from a natural sound generated by a natural musical instrument.

9. A sound generator according to claim 7, wherein each of said waveform data combinations consists of a plurality of digital data each having a same data length which represent respective levels of said waveform, a maximum level of said waveform being represented by a maximum value expressable within said data length.

10. A sound generator according to claim 7, wherein said waveform and loudness specifying means comprises a read only memory.

11. A sound generator according to claim 7, wherein said keyboard information further includes a pitch information.

12. A sound generator according to claim 11, wherein said waveform and loudness specifying means comprises a loudness information generating means for generating said loudness information from said touch information, and an address generating means for decoding said loudness information and said pitch information into said address signal.

13. A sound generator according to claim 11, wherein said waveform and loudness specifying means comprises a loudness information generating means for generating said loudness information from said keyboard information, and an address generating means for decoding said loudness information and said pitch information into said address signal.

14. A sound generator for an electronic musical instrument, comprising:

a keyboard;

a memory means for storing a plurality of waveform data combinations each of which represents a waveform obtained from a natural sound;

a conversion means for converting a first touch information from said keyboard to a predetermined sound touch information, said first touch information representing at least one of a depressing speed and a depressing strength of a key of said keyboard;

a waveform specifying means for generating an address signal for said memory means from at least said second touch information thereby specify one of said waveform data combinations;

a tone generating means for generating a tone from an output of said memory means; and a loudness control means for controlling loudness level of the generated tone in response to at least said second touch information.

15. A sound generator according to claim 14, wherein said waveform specifying means generates said address signal from said second touch information and a pitch information from said keyboard.

16. A sound generator according to claim 15, wherein said loudness control means is responsive to said second touch information and said pitch information.

17. A sound generator according to claim 14, wherein said waveform is obtained from a natural sound generated by a natural musical instrument.

18. A sound generator according to claim 14, wherein each of said waveform data combinations is obtained by digital conversion of partial or total continuum from generation to diminuation of a single tone from among a plurality of tones generated by a natural musical instrument played in different loudnesses at a plurality of selected pitches.

19. A sound generator according to claim 18, wherein said digital conversion includes an information condensation.

20. A sound generator according to claim 14, wherein each of said waveform data combinations consists of a plurality of digital data each having a same data length which represent respective levels of said waveform, a maximum level of said waveform being represented by a maximum value expressable within said data length.

21. A sound generator according to claim 14, wherein said conversion means comprises a read only memory.

22. A sound generator for an electronic musical instrument, comprising:

a keyboard;

a memory means for storing a plurality of waveform data combinations each of which represents a waveform obtained from a natural sound;

a first conversion means for converting a first touch information from said keyboard to a predetermined second touch information, said first touch information representing at least one of a depressing speed and a depressing strength of a key of said keyboard;

a second conversion means for converting said second touch information and a pitch information from said keyboard to an address signal for said memory means and a loudness information;

a tone generating means for generating a tone from an output of said memory means; and a loudness control means for controlling loudness level of the generated tone in response to said loudness information.

23. A sound generator according to claim 22, wherein said waveform is obtained from a natural sound generated by a natural musical instrument.

24. A sound generator according to claim 22, wherein each of said waveform data combinations is obtained by digital conversion of partial or total continuum from generation to diminuation of a single tone from among a plurality of tones generated by a natural musical instrument played in different loudnesses at a plurality of selected pitches.

25. A sound generator according to claim 22, wherein each of said waveform data combination consists of a plurality of digital data each having a same data length which represent respective levels of said waveform, a maximum level of said waveform being represented by a maximum value expressable within said data length.

26. A sound generator according to claim 22, wherein each of said first and second conversion means comprises a read only memory.

* * * * *